US010876233B2

(12) United States Patent
Lonati et al.

(10) Patent No.: US 10,876,233 B2
(45) Date of Patent: Dec. 29, 2020

(54) OPEN-TYPE CIRCULAR KNITTING MACHINE FOR THE OPEN AND WIDTH-VARIABLE WEB PRODUCTION

(71) Applicant: SANTONI S.P.A., Brescia (IT)

(72) Inventors: Ettore Lonati, Botticino (IT); Fausto Lonati, Brescia (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 231 days.

(21) Appl. No.: 15/776,040

(22) PCT Filed: Oct. 12, 2016

(86) PCT No.: PCT/IB2016/056104

§ 371 (c)(1),
(2) Date: May 14, 2018

(87) PCT Pub. No.: WO2017/081564

PCT Pub. Date: May 18, 2017

(65) Prior Publication Data

US 2018/0274139 A1 Sep. 27, 2018

(30) Foreign Application Priority Data

Nov. 12, 2015 (IT) ..... 102015000071942

(51) Int. Cl.
*D04B 15/88* (2006.01)
*D04B 35/34* (2006.01)
*D04B 9/02* (2006.01)

(52) U.S. Cl.
CPC ..... *D04B 15/88* (2013.01); *D04B 9/02* (2013.01); *D04B 35/34* (2013.01)

(58) Field of Classification Search
CPC ..... D04B 15/88; D04B 9/02; D04B 35/34
(Continued)

(56) References Cited

U.S. PATENT DOCUMENTS 3,855,822 A * 12/1974 Lee ..... D04B 35/34 66/147
4,314,462 A * 2/1982 Ducol ..... D04B 15/88 66/152

(Continued)

FOREIGN PATENT DOCUMENTS

GB 343 534 A 2/1931
GB 1 251 252 A 10/1971

(Continued)

OTHER PUBLICATIONS

Jan. 18, 2017 International Search Report issued in International Patent Application No. PCT/IB2016/056104.

(Continued)

*Primary Examiner* — Danny Worrell
(74) *Attorney, Agent, or Firm* — MH2 Technology Law Group, LLP

(57) ABSTRACT

An open-type circular knitting machine for the open and width-variable web production with a knitted fabric take-down and/or collecting assembly, including: a basement, knitting head and take-down and/or collecting assembly for the fabric. The head is equipped with a needle-holding element having a plurality of needles arranged around a central axis; a first and last active needle delimit a dead zone of the element without needles, and an arc-shaped operating zone with active needles. The head has a control device connected to the active needles to selectively actuate them to produce an open knitted fabric extending between two side edges making up two selvedges of the fabric. The assembly is downstream from the head with respect to feeding direction of the fabric, configured for rotating integral or coordinated with the element during production. Further, at least a first cutting device, configured for progressively cutting and/or trimming the produced fabric.

20 Claims, 18 Drawing Sheets

(58) Field of Classification Search
USPC ..... 66/150–153
See application file for complete search history.

(56) References Cited

U.S. PATENT DOCUMENTS

| | | | | |
|---|---|---|---|---|
| 5,317,885 | A | 6/1994 | Vignoni | |
| 6,568,221 | B2 * | 5/2003 | Seeger | D04B 15/00 66/8 |
| 6,640,590 | B2 * | 11/2003 | Thoman | D04B 15/88 66/153 |
| 7,162,895 | B2 * | 1/2007 | Lonati | D04B 15/88 66/151 |
| 7,882,712 | B2 * | 2/2011 | Schaut | D04B 35/34 66/151 |
| 2002/0157427 | A1 * | 10/2002 | Seeger | D04B 15/00 66/8 |
| 2002/0166347 | A1 * | 11/2002 | Thoman | D04B 15/88 66/8 |
| 2005/0229642 | A1 * | 10/2005 | Lonati | D04B 15/88 66/153 |
| 2009/0158781 | A1 | 6/2009 | Schaut et al. | |

FOREIGN PATENT DOCUMENTS

| | | | |
|---|---|---|---|
| GB | 2 100 297 | A | 12/1982 |
| WO | 2014/191864 | A1 | 12/2014 |

OTHER PUBLICATIONS

Jan. 18, 2017 Written Opinion of the International Searching Authority issued in International Patent Application No. PCT/IB2016/056104.

* cited by examiner

FIG.14
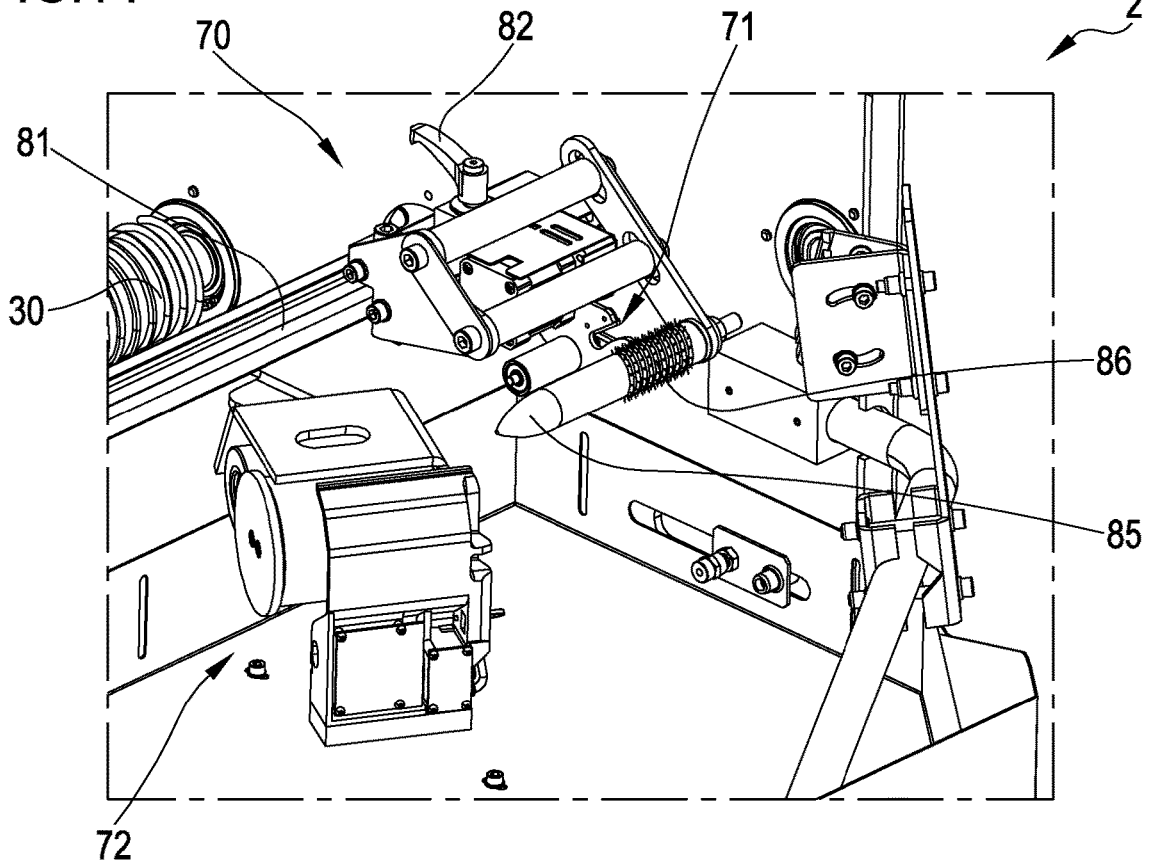
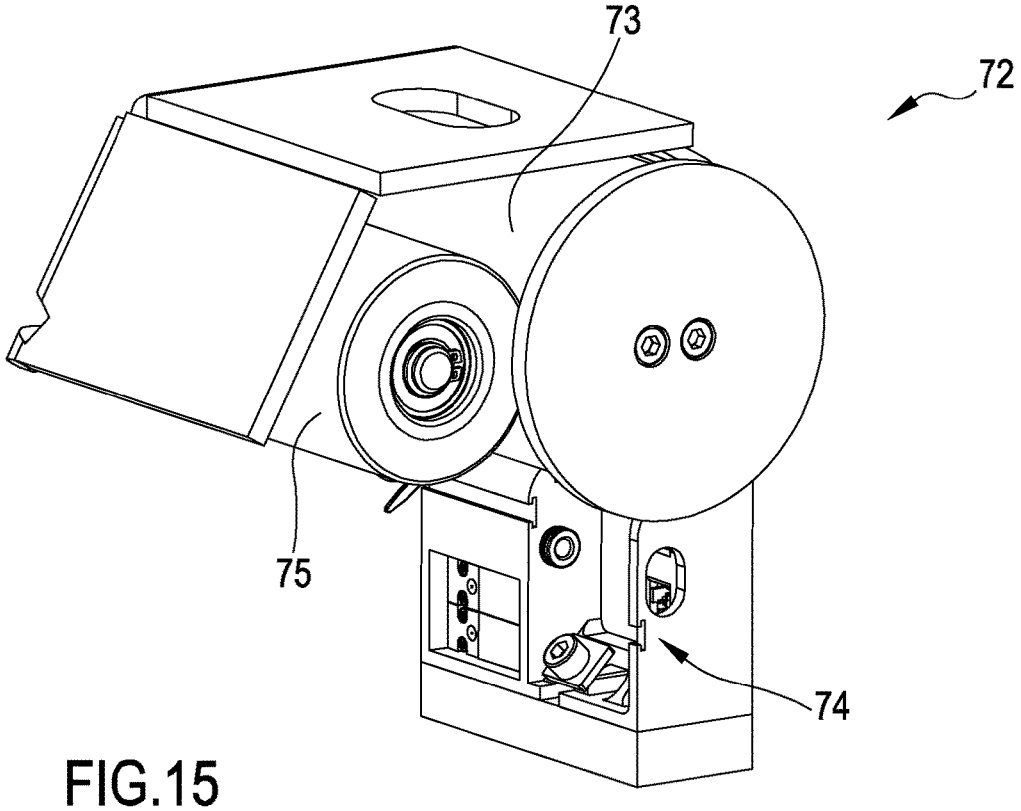
FIG.15

OPEN-TYPE CIRCULAR KNITTING MACHINE FOR THE OPEN AND WIDTH-VARIABLE WEB PRODUCTION

The present invention relates to an open-type circular knitting machine for the open and width-variable web production, preferably with a knitted fabric take-down and/or collecting assembly. Moreover, the present invention relates to a method for producing a fabric on an open-type circular knitting machine for the open and width-variable web production. In addition, the present invention relates to a software or a computer program for an open-type circular knitting machine for the open and width-variable web production.

Circular knitting machines are equipped with at least a needle-holding element (needle cylinder and/or plate) on which one or more series of needles are arranged along a circular path (circular needlebeds) and with devices apt to control the movement of the needles for knitted fabric formation.

It is known about circular knitting machines in which needles develop along a complete circular path, and which are apt to form tubular knitted fabrics which are then cut—using suitable means which the machine is equipped with—along a longitudinal line, and opened so as to be wound in a single layer onto a roll by means of a knitted fabric take/down and collecting assembly or a collecting assembly only. The take-down and/or collecting assembly can spread (or open) the knitted fabric produced by the machine as a cut knitted tube and to collect it in a single layer, typically by winding it onto a collecting roll. The single-layer fabric coming from the needle-holding element and collected by the take-down and/or collecting assembly, is obtained by spreading (or "opening") the tubular knitted fabric that has been cut. In other words, the take-down and/or collecting assembly collects a single-layer fabric (by winding it onto the roll): the single-layer fabric is shaped as a continuous band with a particular width and comes from the machine as a tubular knitted fabric that has been cut and opened. These machines are defined as open-type circular knitting machines. These machines can sometimes comprise only a collecting assembly, i.e. without the take-down function: this occurs e.g. in machines in which the take-down function is implemented directly on the needlebed (e.g. just below the needle-holding cylinder). In this case the knitted fabric produced by the needle-holding element gets down to the collecting assembly, which winds it onto a roll, typically by means of a take-up device. In any case, an open-type machine can be defined as a circular knitting machine in which the produced fabric is collected "in an open mode", i.e. not as a tube but a single layer, by winding it onto a collecting roll. Public document WO 2005100659 discloses an open-type circular knitting machine comprising: a supporting frame, a cylinder associated to the supporting frame and to be actuated in rotation around a central axis of rotation at a first angular speed so as to produce a tubular knitted fabric; a take-down and collecting assembly operatively associated to the supporting frame and actuated in rotation around the central axis of rotation at a second angular speed differing from the first one; cutting means operatively associated to the take-down and collecting assembly so as to progressively cut the tubular knitted fabric along a predefined cutting trajectory, wherein the cutting means are integral with the take-down and collecting assembly and are apt to cut the fabric along an inclined trajectory with respect to the central axis of rotation. The take-down and collecting assembly further comprises spreading means provided with two spreading rolls apt to open the cut fabric and a return roll for the open fabric.

It is further known about open-type circular knitting machines in which the needles develop in series along a path shaped as an arc of circle (less than 360°), and which are apt to form knitted fabrics (or webs) with a partial or partially tubular circumferential development (fabric production directly in open mode). In other words, the needle cylinder and/or plate of these machines has/have a zone (referred to as "dead zone") without needles. During fabric formation, these machines rotate continuously as when producing a tubular fabric, but are equipped with suitable devices that allow at every revolution to begin thread feeding on the first needle (of the series shaped as an arc of circle) and to interrupt feeding on the last operating needle; in the "dead zone" no fabric is produced (since needles are absent). Thus, the machine produces a fabric with a partially tubular development though already open and therefore—once it has come down or out of the needle-holding element—already consisting of a continuous fabric band with a particular width.

The fabric band (or web) continuously produced by the knitting machine extends longitudinally in a continuous manner between two side (right and left) edges or ends on a fabric width—or height—defined by the number of active needles, i.e. by the extension of the dead zone. The larger the number of active needles, the smaller the extension of the dead zone and the larger the width of the produced fabric.

Each one of the two side edges (right and left edge of the produced fabric web) makes up the part known as "selvedge" in the technical jargon of the textile industry. In the framework of open-type circular knitting machines for the direct open web production, selvedges are therefore the two side portions, i.e. the edges, of the fabric which are created, at every rotation of the circular machine, as a result of the interruption and takeup of the yarn occurring at the beginning and at the end of the needle-less "dead zone", respectively. Selvedges have cut and torn yarns and develop in general irregularly.

For this reason, when the fabric is used to produce a textile item, e.g. an item of clothing, during manufacturing selvedges are removed since they cannot be used.

Document IT01244605 discloses a circular knitting machine for open fabric production provided with a needle cylinder and with a plate having a section without needles, and with a thread pinching and cutting device arranged near this section. It is further known about circular knitting machines for open fabric production provided with a take-down assembly for fabric under formation. Concerning this, known document EP0893527 discloses a device for taking down knitted fabrics in circular machines for producing tubular fabric with an open development. The device comprises a plurality of tensioning rolls whose axes are arranged in a polygonal shape inside the needle cylinder and can be actuated in an independent manner.

It is further known about circular knitting machines for open-type production (provided with a dead zone), in which the number of active needles and therefore the extension of the arc of circle mentioned above can be varied. It is thus possible to produce fabric with different fabric widths—or heights—on the same machine. These machines are also known as width-variable web machines. Known width-variable web machines are equipped with devices enabling to vary the number of operating needles reducing—starting from the last needle—the number of active needles on the machine (i.e. varying the extension of the dead zone, of the path shaped as an arc of circle and the width of the produced fabric).

In the framework of open-type circular knitting machines for the open and width-variable web production, the Applicant has found some drawbacks.

First of all, taking down the fabric produced directly in open mode involves some difficulty since the fabric tends to roll up in a non-uniform manner onto the collecting roll. In particular, the two selvedges making up the outer edges of the produced fabric, due to the presence of cut yarns and of their irregular development, tend to roll up in a non-uniform manner onto the collecting roll and to pile up at every roll rotation, thus creating a higher fabric thickness on the sides of the collecting roll.

Moreover, due to the elasticity of the fabric, selvedges tend to curl and pile up, thus preventing the fabric from correctly stretching on the collecting roll. The roll of collected fabric therefore has non-uniform outer edges, which are not correctly stretched and are quite thick with respect to the middle portion of the roll. This makes it difficult to perform the following operations on the fabric roll, in particular the processing steps for manufacturing textile items.

In addition, the non-uniform fabric collection due to the selvedges does not allow to fully exploit the opportunities offered by the open and width-variable web production. As a matter of fact, the variation in the number of working needles enables to change the width of the fabric web (i.e. the distance between the selvedges) and to collect an open web having directly such a width: however, the selvedges piling up on the edges do not allow to arrange the fabric on its whole width and makes it necessary—when using the fabric—to stretch it again in order to remove non-uniformities due to selvedges.

Moreover, the Applicant has found that the angular position of the fabric under formation with respect to the take-down and/or collecting assembly changes when the number of active needles varies. In particular, if, as described above, the machine allows to vary the number of needles under formation starting from the last needle only, the middle line of the dead zone (meaning the plane of symmetry of the dead zone containing the main axis of the needle cylinder) is not fixed but moves as the active needles vary, as well as the middle line of the path shaped as arc of circle defined by said active needles and therefore the middle line of the fabric under formation.

The Applicant has further observed that this phenomenon affects the take-down and/or collecting operations executed downstream from the fabric formation area, and therefore the quality of the fabric produced. In particular, the Applicant has observed that this phenomenon affects the distribution of the take-down forces in the fabric, and the fabric piling-up modes in the collecting area.

Moreover, the Applicant has noticed that, if the take-down and/or collecting elements have their own symmetry, this symmetry should preferably be maintained also with respect to the fabric under formation so as to ensure the correct execution of the take-down and collecting operations.

Under these circumstances, the aim underlying the present invention in its various aspects and/or embodiments, is to provide an open-type circular knitting machine for the open and width-variable web production that has a better quality than those at the state of the art.

A particular aim of the present invention is to propose an open-type circular knitting machine for the open and width-variable web production that allows to correctly take down the web under formation whatever the number of active needles used and therefore for every fabric web width.

Another aim of the present invention is to propose an open-type circular knitting machine for the open and width-variable web production that allows to correctly collect in a single layer the web under formation, thus preventing the fabric from piling up and obtaining a well-stretched, uniform fabric roll.

Another aim of the present invention is to propose an open-type circular knitting machine for the open and width-variable web production that allows to correctly collect in a single layer the web under formation whatever the number of active needles used and therefore for every web width.

These and other possible aims, which shall appear better from the following description, are basically achieved by an open-type circular knitting machine for the open and width-variable web production with a fabric take-down and/or collecting assembly, and/or by a method and/or a software, according to one or more of the appended claims and according to the following aspects and/or embodiments, variously combined, also with the aforesaid claims.

The claims and the aspects of the present invention, where they relate to an open-type machine for the open and width-variable web production, thus specifically identify a knitting machine having the characteristics described above, which characteristics identify and define this type in a clear and unambiguous manner within the reference field, and can be clearly understood by a skilled technician. The terms used in the claims and in the aspects should therefore be correctly construed in the light of this information about the reference technical field. In particular, the characteristics according to which the machine of the present invention is of the open-type, for the open and width-variable web production, have to be understood as precise technical characteristics, which are limiting and should not be understood as a mere example of a knitting machine, among the large number of existing types, into which machine the other technical characteristics disclosed in the claims and/or in the aspects can be integrated.

Some aspects of the invention are listed below.

In a first aspect, the invention relates to an open-type circular knitting machine for the open and width-variable web production, comprising:

a basement;

a knitting head mounted onto the basement and comprising:

at least a needle-holding element having at least a plurality of needles arranged around a central axis; a first active needle and a last active needle of said plurality delimiting between them a dead zone of the needle-holding element without needles and/or without active needles, and an operating zone shaped as an arc of circle and provided with active needles;

control means operatively connected at least to the active needles so as to selectively actuate said active needles in order to produce an open knitted fabric, said open knitted fabric extending longitudinally in a continuous manner between two side edges making up two selvedges of the knitted fabric.

In one aspect, the machine comprises at least a cutting device arranged downstream from the needle-holding element and configured for progressively cutting and/or trimming the produced fabric.

In one aspect, said at least a cutting device is arranged near the needle-holding element.

In one aspect, said at least a cutting device is arranged immediately downstream from the needles with respect to a feeding direction of the produced fabric.

In one aspect, said at least a cutting device is placed in a needle-holding cylinder belonging to the needle-holding element, i.e. positioned inside the volume defined by the circumference of said needle-holding cylinder.

In one aspect, said at least a cutting device is configured for cutting and/or trimming at least one selvedge of the open fabric. In one aspect, trimming the fabric comprises cutting/smoothing only and at least partly yarns protruding from the fabric itself.

The Applicant has found out that the installation of said at least one cutting device in the needle-holding cylinder and immediately downstream from the needles enables to cut or trim with an extremely high accuracy the edge or edges of the fabric just produced. In particular, this solution allows to set whether to cut only, wholly or partly the yarns protruding from the edge or also from a part of the edge, and to accurately set the length of the yarns or the width of the band to be cut.

In one aspect, said at least a cutting device rotates with the fabric during the production of the fabric itself.

In one aspect, said at least a cutting device is arranged near the first active needle and/or near the last active needle so as to cut and/or trim at least one selvedge of the open fabric.

In one aspect, the machine comprises a first cutting device positioned near the first active needle and configured for cutting and/or trimming a first selvedge of the open fabric, and a second cutting device positioned near the last active needle and configured for cutting and/or trimming a second selvedge of the open fabric. In one aspect, the machine comprises adjusting elements, either manual or automatic, operatively associated with the first and/or the second cutting device and configured for varying the position of said first and/or second cutting device with respect to the first active needle and/or to the last active needle.

In one aspect, the adjusting elements are configured for moving and blocking the cutting devices along a circular path coaxial with the central axis.

In one aspect, the machine comprises a suction device operatively associated with said at least a cutting device and configured for removing waste, preferably threads, deriving from the cutting operation.

In one aspect, the suction device has a suction opening placed near the cutting element of said at least a cutting device.

In one aspect, said at least a cutting device comprises a supporting body carrying the cutting element, wherein the suction opening is built into said supporting body.

In one aspect, the suction device comprises: a suction element, fixed with respect to the basement; a rotating manifold positioned under the knitting head; first tubes in fluid communication with the suction opening of said at least a cutting device and with the rotating manifold; second tubes in fluid communication with the rotating manifold and with the suction element.

In one aspect, a perforated tank is placed in-line on the first and/or second tubes for collecting cutting waste.

In one aspect, the knitting machine further comprises a take-down and/or collecting assembly for the knitted fabric under production, arranged downstream from the knitting head with respect to a feeding direction of said knitted fabric under production, wherein said take-down and/or collecting assembly is configured for rotating integral or coordinated with said needle-holding element during the production of the knitted fabric.

In one aspect, the first tubes are mounted onto the take-down and/or collecting assembly and the rotating manifold is positioned under said take-down and/or collecting assembly.

In one aspect, the take-down and/or collecting assembly comprises at least a first cutting device configured for progressively cutting the produced fabric so as to divide it into at least two distinct webs.

In one aspect, the first cutting device is configured for progressively cutting a first selvedge of the open knitted fabric, so that said two distinct webs correspond to said first selvedge and to a fabric web without said first selvedge.

In one aspect, the cutting device or cutter is integral with the take-down and/or collecting assembly and rotates with it during the production of the fabric.

In one aspect, the cutting device comprises a cutting element configured for cutting the fabric produced by the knitted machine. In one aspect, the cutting element is a blade or a pair of scissors or an ultrasonic cutting element or a heating cutting element.

In one aspect, the cutting device comprises a take-down roll configured for receiving the selvedge cut by said cutting element, for taking it away from the cutting element itself and for maintaining it stretched.

In one aspect, the take-down and/or collecting assembly comprises:

spreading devices configured for opening and stretching in a single layer the knitted fabric produced by the knitting head, and comprising at least a spreading bar;

devices for piling up the knitted fabric stretched, comprising at least a collecting roll.

In one aspect, the cutting device is arranged upstream, preferably immediately upstream, from said collecting roll.

In one aspect, the take-down and/or collecting assembly comprises first mounting elements configured for enabling the positioning and mounting of said cutting device into the take-down and/or collecting assembly.

In one aspect, the mounting elements comprise a rectilinear guide developing parallel to an axis of development of the collecting roll and configured for housing said cutting device and selectively placing it in a given position with respect to the fabric produced by the knitting machine and/or to the collecting roll.

In one aspect, the mounting elements comprise a hooking device associated with said cutting device and configured for enabling a manual, reversible mounting of the cutting device to said rectilinear guide in a given position, along said guide, which can be selected based on the width of said operating zone provided with active needles and/or based on the position in which the produced fabric has to be cut so as to be divided into said two distinct webs.

In one aspect, which is either additional or alternative to the previous one, the mounting elements comprise a positioning device acting upon said cutting device and configured for enabling an automatic selection of the position of the cutting device along said rectilinear guide, preferably based on the width of said operating zone provided with active needles and/or based on the position in which the produced fabric has to be cut so as to be divided into said two distinct webs.

In one aspect, the knitting machine comprises devices for varying the number of active needles in the operating zone so as to adjust the width of the knitted fabric.

In one aspect, the positioning device comprises a control unit operatively connected to a motor configured for moving the cutting device along said guide, and wherein the control unit is configured for receiving as input the number of active needles, calculating the correct position of the cutting device with respect to the collecting roll based on the fabric width corresponding to the number of active needles, and for providing as output the correct position of cutting device or for accordingly controlling the motor and directly adjusting the position of the cutting device along said guide.

In one aspect, the take-down and/or collecting assembly comprises a first opening device or temple, placed on said first cutting device and upstream from the first cutting device, the opening device being configured for receiving and keeping open the fabric produced by the needle-holding element at least on said first selvedge to be cut, so as to let the cutting element act upon the selvedge once it is uniform and well stretched.

In one aspect, the opening device comprises a cylinder or pin provided with a plurality of rivets configured for engaging the selvedge and keeping it open and stretched when entering the cutting element. In one aspect, the cylinder or pin can rotate freely.

In one aspect, the take-down and/or collecting assembly further comprises a second cutting device, configured for progressively cutting the produced fabric so that the produced fabric, as a result of the cutting operations performed by the first cutting device and by the second cutting device, is divided into three or more distinct webs.

In one aspect, the second cutting device is configured for progressively cutting a second selvedge of the open knitted fabric, making up the side edge of the fabric opposite the side edge of the first selvedge, so that said three or more distinct webs correspond at least to said first selvedge, to said second selvedge and to a fabric web without the first and the second selvedge.

In one aspect, the second cutting device corresponds to the first cutting device and comprises one or more of the aforesaid technical features described for the first cutting device.

According to further aspects, the second cutting device or cutter:

is integral with the take-down and/or collecting assembly and rotates with it during the production of the fabric:

comprises a respective cutting element configured for cutting said second selvedge;

comprises a respective take-down roll configured for receiving the selvedge cut by the cutting element of the second cutting device, for taking it away from the cutting element itself and for maintaining it stretched;

is arranged upstream, preferably immediately upstream, from said collecting roll.

In one aspect, the take-down and/or collecting assembly comprises second mounting elements configured for enabling the positioning and mounting of the second cutting device into the take-down and/or collecting assembly.

In one aspect, the second mounting elements comprise a respective rectilinear guide developing parallel to an axis of development of the collecting roll and configured for housing the second cutting device and selectively placing it in a given position with respect to the collecting roll.

In one aspect, the second mounting elements can comprise a respective hooking device, similar to the one described above for the first cutting device.

Preferably, all the technical features of the elements described for the first cutting device can be present also in corresponding elements of the second cutting device.

In a further aspect thereof, the knitting machine comprises devices for adjusting the angular position of the take-down and/or collecting assembly with respect to the dead zone of the needle-holding element around the central axis. In other words, the machine according to the invention is provided with a take-down and/or collecting assembly which during fabric production is in a fixed angular position (around the main axis) with respect to the needle-holding element and with respect to the dead zone, though it can be moved (by rotating and blocking it with respect to the needle-holding element) between one manufacturing cycle and the following one when the machine is idle.

In one aspect, the take-down and/or collecting assembly is hung below the knitting head, and the adjusting devices are operatively placed between said take-down and/or collecting assembly and the knitting head.

In one aspect, the adjusting devices are of the manual adjustment type or comprise at least a motor configured for moving the take-down and/or collecting assembly with respect to the needle-holding element.

In one aspect, the machine comprises devices for varying the number of active needles in the operating zone so as to adjust the width of the knitted fabric; wherein the adjusting devices comprise a control unit operatively connected to a motor configured for moving the take-down and/or collecting assembly with respect to the needle-holding element; wherein the control unit is configured for receiving as input the number of active needles, calculating the correct position of the take-down and/or collecting assembly corresponding to said number of active needles, and for providing as output the angular position of the take-down and/or collecting assembly or for accordingly controlling the motor and directly adjusting said angular position.

In one aspect, the take-down and/or collecting assembly comprises take-down elements for the knitted fabric produced, wherein the take-down elements comprise at least a take-down roll, preferably placed between said needle-holding element and said collecting roll.

In a further aspect, the present invention relates to a method for producing a fabric comprising the following steps:

arranging an open-type circular knitting machine for the open and width-variable web production, comprising:

a basement;

a knitting head mounted onto the basement and comprising:

at least a needle-holding element having at least a plurality of needles arranged around a central axis; a first active needle and a last active needle of said plurality delimiting between them a dead zone of the needle-holding element without needles and/or without active needles, and an operating zone shaped as an arc of circle and provided with active needles; control means operatively connected at least to the active needles so as to selectively actuate said active needles in order to produce an open knitted fabric, said open knitted fabric extending longitudinally in a continuous manner between two side edges making up two selvedges of the knitted fabric;

producing at least a portion of an open knitted fabric, said open knitted fabric extending longitudinally in a continuous manner between two side edges making up two selvedges of the knitted fabric;

cutting and/or trimming, by means of said first cutting device, the produced fabric.

In one aspect, said at least a cutting device is arranged near the needle-holding element.

In one aspect, said at least a cutting device is arranged immediately downstream from the needles with respect to a feeding direction of the produced fabric.

In one aspect, the two side edges are two selvedges of the fabric. In one aspect, said cutting step comprises trimming at least one selvedge of the open fabric. In one aspect, trimming comprises cutting only and at least partly yarns protruding from the fabric. In one aspect, said cutting step is made in a continuous and synchronized manner with said step of producing at least a portion of an open knitted fabric.

In one aspect, the machine comprises a first cutting device positioned near the first active needle, and a second cutting device positioned near the last active needle.

In one aspect, the cutting step comprises cutting and/or trimming a first selvedge of the open fabric, trimming comprises cutting/smoothing only and at least partly yarns protruding from the fabric.

In one aspect, the method comprises:

selecting among said plurality of needles of the needle-holding element a plurality of active needles, i.e. selecting the width of said operating zone;

adjusting the position of said first and/or second cutting device with respect to the first active needle and/or to the last active needle as a function of the width of said operating zone.

In one aspect, the machine comprises a take-down and/or collecting assembly for the knitted fabric under production, arranged downstream from the knitting head with respect to a feeding direction of said knitted fabric under production, wherein said take-down and/or collecting assembly is configured for rotating integral or coordinated with said needle-holding element during the production of the knitted fabric.

In one aspect, the take-down and/or collecting assembly comprises at least a first cutting device configured for progressively cutting the produced fabric so as to divide it into at least two distinct webs.

In one aspect, said cutting step is made in a continuous, simultaneous or synchronized manner with said step of producing at least a portion of an open knitted fabric.

In one aspect, during said knitting step the first cutting device is configured for progressively cutting a first selvedge of the open knitted fabric, so that the aforesaid two distinct webs correspond to said first selvedge and to a fabric web without said selvedge.

In one aspect, the take-down and/or collecting assembly comprises the aforesaid second cutting device and the method comprises a step of cutting, by means of the second cutting device, the produced fabric so that the produced fabric, as a result of the cutting operations performed by the first cutting device and by the second cutting device, is divided into three or more distinct webs. In one aspect, in said cutting step by means of the second cutting device, the second cutting device progressively cuts a second selvedge of the open knitted fabric, making up the side edge of the fabric opposite the side edge of the first selvedge, so as to obtain three or more distinct webs corresponding at least to said first selvedge, to said second selvedge and to a fabric web without the first and the second selvedge.

In one aspect, the take-down and/or collecting assembly comprises:

spreading devices configured for opening and stretching in a single layer the knitted fabric produced by the knitting head, and comprising at least a spreading bar;

devices for piling up the knitted fabric stretched, comprising at least a collecting roll; wherein the method comprises a step of continuously collecting the produced fabric onto said collecting roll.

In one aspect, said cutting step is executed downstream from said step of fabric production and upstream from said step of fabric collection.

In a further aspect, the present invention relates to a take-down and/or collecting set for open-type knitting machines for the open and width-variable web production, comprising: a supporting frame to be firmly connected to the knitting head and/or to the basement of a circular machine; a take-down and/or collecting assembly supported by said supporting frame; at least a cutting device, configured for progressively cutting a selvedge of the open fabric. Said take-down and collecting set can be also installed on already existing machines with variable width web so as to improve the quality of the produced fabric (retrofitting).

In a further aspect, the present invention relates to a method for adjusting the width of a knitted fabric produced on an open-type circular knitting machine for the open and width-variable web production with a knitted fabric take-down and/or collecting assembly, comprising the steps of: setting the width of a dead zone of a needle-holding element of said machine delimited by a first active needle and by a last active needle of at least a plurality of active needles arranged along an operating zone shaped as an arc of circle developing around a central axis; adjusting the angular position of the take-down and/or collecting assembly of said machine with respect to the dead zone. In other words, the position of the take-down and/or collecting assembly with respect to the needle-holding element is corrected based on the number of needles used for fabric formation and therefore on the position of the fabric under formation.

In one aspect, the aforesaid step of adjusting the angular position includes: rotating and then blocking said take-down and/or collecting assembly with respect to the needle-holding element and around said central axis.

In one aspect, the step of adjusting the angular position comprises angularly centering the take-down and/or collecting assembly of said machine with respect to the dead zone.

In one aspect, the step of setting the width of the dead zone comprises: activating or deactivating at least a needle of said plurality of needles starting from the first active needle and/or from the last active needle.

In a further independent aspect, the present invention relates to a method for producing a fabric on an open-type circular knitting machine for the open and width-variable web production, implemented by means of a circular knitting machine claimed in the appended claims and/or described in one or more the listed aspects and/or implemented by means of the take-down and/or collecting set described in one or more of the listed aspects.

The Applicant has found out that the invention, in one or more of the aspects thereof, allows to solve the problems related to the selvedges of a fabric web produced with an open-type circular knitting machine for the open and width-variable web production.

Furthermore, the Applicant has found out that the invention, in one or more of the aspects thereof, allows to select and set in a precise and repeatable manner the angular position (which then remains unchanged during a manufacturing cycle) of the take-down and/or collecting assembly with respect to the operating zone shaped as an arc of circle provided with active needles, and therefore with respect to the fabric under formation so as to optimize fabric take-down and/or collecting operations and thus ensure product quality. In particular, the Applicant has found out that the invention allows to ensure the correct distribution of the take-down forces on the fabric coming down from the needle-holding element. The Applicant has also found out that the invention allows to collect the formed fabric in an orderly fashion and/or without folds or defects. The Applicant has further found out that the invention allows to select and set said optimized angular position as a function of the number of active needles (and therefore of the width of the dead zone), i.e. of the width of the fabric under formation on the machine.

It should be pointed out again that in the present description and in the appended claims, the term "dead zone" means the zone of the needle-holding element (extending as an arc of circle) that does not take part in fabric formation because it is without needles or because it is provided with inactive needles or because it is partly without needles and partly provided with inactive needles. This dead zone is delimited by the complementary operating zone shaped as an arc of circle and provided with active needles, i.e. needles getting into contact with the threads and taking part in fabric formation.

The circular knitting machines according to the present invention, in their various aspects, can be single needlebed (with only one needle cylinder) or double needlebed (with needle cylinder and needle plate).

The circular knitting machines according to the present invention, in their various aspects, can be of the type with rotating needle-holding element (with non-rotating needle control means and take-down and/or collecting assembly rotating with the needle-holding element during fabric production) or with fixed needle-holding elements ((with rotating needle control means and fixed take-down and/or collecting assembly during fabric production)

Further aspects of the invention are listed below.

In one aspect, the take-down and/or collecting assembly is hung below the knitting head. In one aspect, the take-down and/or collecting assembly is hung to and supported by the needle-holding element. Under these circumstances, adjustment is preferably executed by rotating of a predefined angle the take-down and/or collecting assembly with respect to the knitting head while this assembly preferably remains hung.

In a different aspect, the take-down and/or collecting assembly rests on the ground or on the basement and is firmly connected to the needle-holding element.

If one aspect, if the needle-holding element is of the rotating type, the take-down and collecting assembly is dragged in rotation during fabric production by the rotation of said needle-holding element and rotates integrally with said needle-holding element, i.e. without any relative rotation with respect to said needle-holding element. The motor moving the needle-holding element and the take-down and/or collecting assembly can therefore be one only, thus reducing overall dimensions and costs.

In one aspect, if the needle-holding element is of the fixed type, the take-down and collecting assembly is fixed, i.e. without any relative rotation with respect to said needle-holding element.

In one aspect, the adjusting devices are operatively placed between said take-down and/or collecting assembly and the knitting head. In one aspect, the adjusting devices are operatively placed between said take-down and/or collecting assembly and the basement.

In one aspect, a supporting frame is/can be firmly connected to the knitting head and/or to the basement and supports the take-down and/or collecting assembly. The adjusting devices are integrated into said supporting frame. The set including the take-down and/or collecting assembly and the aforesaid frame can thus be easily mounted and dismounted also on already existing machines.

In one aspect, adjusting the angular position includes: rotating and then blocking said take-down and/or collecting assembly with respect to the needle-holding element and around said central axis.

In one aspect, the adjusting devices are of the manual adjustment type. Position adjustment is made by the manual intervention of an operator, if required by means of dedicated tools.

In one aspect, the adjusting devices comprise at least a motor configured for moving the take-down and/or collecting assembly with respect to the needle-holding element. In this case, adjustment is made by the motor as a result of an operator's command or automatically as a result of other adjustments.

In one aspect, the adjusting devices comprise a control unit, preferably of electronic type, operatively connected to the motor and configured for receiving at least one datum related to said angular position and for controlling the motor accordingly. The operator can e.g. insert an angular value into the control unit by means of input devices (keyboard, touchscreen, mouse, etc.) and the control unit controls the motor so that it moves the take-down and/or collecting assembly accordingly.

In one aspect, the machine comprises devices for varying the number of active needles in the operating zone (and thus the width of the dead zone) so as to adjust the width of the knitted fabric. In one aspect, setting the width of the dead zone comprises: activating or deactivating at least a needle of said plurality of needles starting from the first active needle and/or from the last active needle. In one aspect, setting the width of the dead zone comprises: spacing apart or moving close at least a needle of said plurality of needles from the first active needle and/or from the last active needle. In one aspect, setting the width of the dead zone comprises: dismounting or mounting at least a needle of said plurality of needles from/to the first active needle and/or from/to the last active needle.

In one aspect, the adjusting devices comprise a control unit, preferably of electronic type, configured for receiving at least one datum related to the width of the dead zone and for providing as output the angular position of the take-down and/or collecting assembly or for controlling the motor accordingly and directly adjusting said angular position.

In one aspect, the adjusting devices comprise a control unit, preferably of electronic type, configured for receiving at least one datum related to the width of the knitted fabric, so as to adjust width of the dead zone accordingly by activating or deactivating a given number of needles and for providing as output the angular position of the take-down and/or collecting assembly or for controlling the motor accordingly and directly adjusting said angular position.

In one aspect, the control unit is configured for receiving as input the number of active needles, calculating the correct position of the take-down and/or collecting assembly corresponding to said number of active needles, and for providing as output the angular position of the take-down and/or collecting assembly or for controlling the motor accordingly and directly adjusting said angular position.

The variation of the number of needles can include a variation of the middle line of the dead zone and thus of the operating zone (or of the plane of symmetry of the dead zone where the central axis lies), which can require the adjustment of the angular position. This variation of the middle line is unavoidable if the needles can be activated or deactivated starting from one end only of the dead zone (usually starting from the last needle of the operating zone=.

In one aspect, adjusting the angular position comprises angularly centering the take-down and/or collecting assembly of said machine with respect to the dead zone. Since usually though not necessarily the take-down and/or collecting assembly has its own plane of symmetry (where the central axis lies) and since for a correct management of the fabric under formation (take-down and/or collecting) it is necessary for that plane of symmetry to coincide with the middle line of the dead zone, the centering step described above is important during production.

In one aspect, the take-down and/or collecting assembly comprises collecting devices only.

In one aspect, the take-down and/or collecting assembly comprises tale-down devices only.

In one aspect, the take-down and/or collecting assembly comprises both take-down and collecting devices.

In one aspect, the take-down and/or collecting assembly is basically symmetrical with respect to a plane of symmetry containing the central axis.

In one aspect, the take-down and/or collecting assembly comprises spreading devices configured for opening and stretching in a single layer the knitted fabric produced by the knitting head. The formed fabric getting down from the knitting head as a partially open tube gets into contact with the spreading devices and is opened until it lies in a single layer and in a plane.

In one aspect, the spreading devices have a symmetrical pattern with respect to a plane of symmetry containing the central axis. The symmetry of the spreading devices enables to open the fabric with a symmetrical movement (with respect to the open zone of the fabric, i.e. the dead zone of the needle-holding element).

In one aspect, the take-down and/or collecting assembly comprises devices for piling up the stretched fabric.

In one aspect, the piling-up devices comprise at least a collecting roll. In one aspect, the collecting roll has a rectilinear axis. In one aspect, the axis of the collecting roll is orthogonal to the plane of symmetry of the spreading bar. The fabric, preferably after being opened by passing over the spreading bar, is wound as a bobbin and in a single layer onto the collecting roll.

In one aspect, the take-down and/or collecting assembly comprises take-down elements for the produced fabric. In one aspect, the take-down elements comprise at least a take-down roll, preferably at least a pair of take-down rolls. In one aspect, said at least one take-down roll has a rectilinear axis. In one aspect, said at least one take-down roll is parallel to the collecting roll.

In one aspect, the piling-up devices and the spreading devices, and if necessary the take-down elements, are integral with each other during adjustment.

In a further independent aspect thereof, the present invention relates to a method for producing a fabric comprising the steps of:

arranging an open-type circular knitting machine for the open and width-variable web production with a knitted fabric take-down and/or collecting assembly, according to one or more of the aspects;

selecting among said plurality of needles of the needle-holding element a plurality of active needles, i.e. selecting the width of said operating zone;

defining a given knitted braid or knitted structure for the fabric to be produced by means of the active needles of the operating zone;

producing at least a portion of an open knitted fabric by means of the active needles of the operating zone, said open knitted fabric extending longitudinally in a continuous manner between two side edges making up two selvedges of the knitted fabric;

automatically placing said cutting device with respect to the produced fabric;

progressively cutting by means of said first cutting device the produced fabric so as to divide it into at least two distinct webs.

In one aspect, the method according to the last aspects comprises the following steps:

considering or detecting the number of active needles or the width of the operating zone;

calculating by means of a control unit the correct position of the take-down and/or collecting assembly corresponding to said number of active needles or said width of the operating zone;

determining the angular position of the take-down and/or collecting assembly or accordingly controlling a motor acting upon the take-down and/or collecting assembly, and automatically adjusting said angular position.

The steps according to the previous aspect are preferably executed by means of a control unit.

In one aspect, the method comprises a step of collecting the produced fabric onto a collecting roll preferably of the take-down and/or collecting assembly, In one aspect, said cutting step is made in a continuous and synchronized manner with said step of producing at least a portion of an open knitted fabric.

In one aspect, during said knitting step the first cutting device is configured for progressively cutting a first selvedge of the open knitted fabric, so that said two distinct webs correspond to said selvedge and to a fabric web without said selvedge.

In an independent aspect thereof, the present invention relates to a software, or computer program, for open-type circular knitting machines for the open and width-variable web production, configured for executing one or more of the aforesaid methods, and more generally a method according to any one or more of the above aspects and/or of the claims.

In an independent aspect thereof, the present invention relates to a software configured for implementing the following method:

arranging an open-type circular knitting machine for the open and width-variable web production, according to one or more of the above aspects;

selecting among said plurality of needles of the needle-holding element a plurality of active needles, i.e. selecting the width of said operating zone;

defining a given knitted braid or knitted structure for the fabric to be produced by means of the active needles of the operating zone;

if the take-down and collecting assembly is present, selecting or calculating the correct angular position of said take-down and/or collecting assembly as a function of the number of active needles or of the width of the operating zone, and positioning, either manually or automatically (by means of a control unit and a drive) the take-down and/or collecting assembly in this correct angular position;

producing at least a portion of an open knitted fabric by means of the active needles of the operating zone, said open knitted fabric extending longitudinally in a continuous manner between two side edges making up two selvedges of the knitted fabric;

automatically positioning said cutting device with respect to the produced fabric, based on the position in which the fabric has to be cut (preferably on a selvedge) and/or the edges have to be trimmed;

progressively cutting and/or trimming, by means of said first cutting device, the produced fabric.

In one aspect, the circular knitting machine comprises a control unit (e.g. a controller or a computer) provided (e.g. inside a data storage unit thereof) with a software according to any one or more of the above aspects and/or of the claims.

Further characteristics and advantages shall be more evident from the detailed description of some embodiments, among which also preferred embodiments, which are exemplary though not exclusive, of an open-type circular knitting machine for the open and width-variable web production with a knitted fabric take-down and/or collecting assembly, of a take-down and/or collecting set for open-type circular knitting machines for the open and width-variable web production, of a method for producing a knitted fabric by means of an open-type circular knitting machine for the open and width-variable web production with a knitted fabric take-down and/or collecting assembly according to the present invention.

This description shall be made below with reference to the accompanying drawings, provided to a merely indicative and therefore non-limiting purpose, in which.

Figure 2:
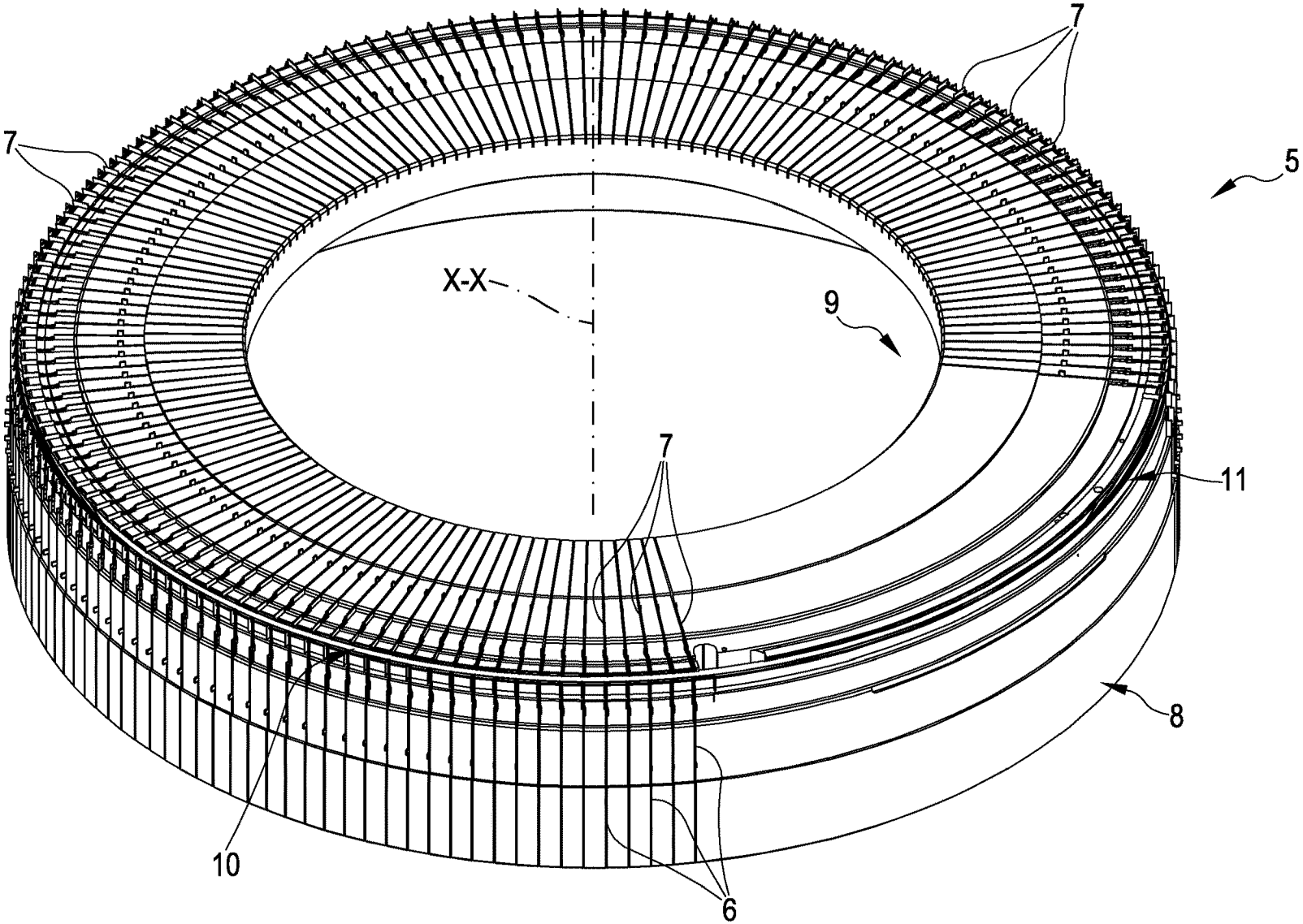
FIG. 2 shows a magnified view of a portion of the machine of FIG. 1.
Figure 5:
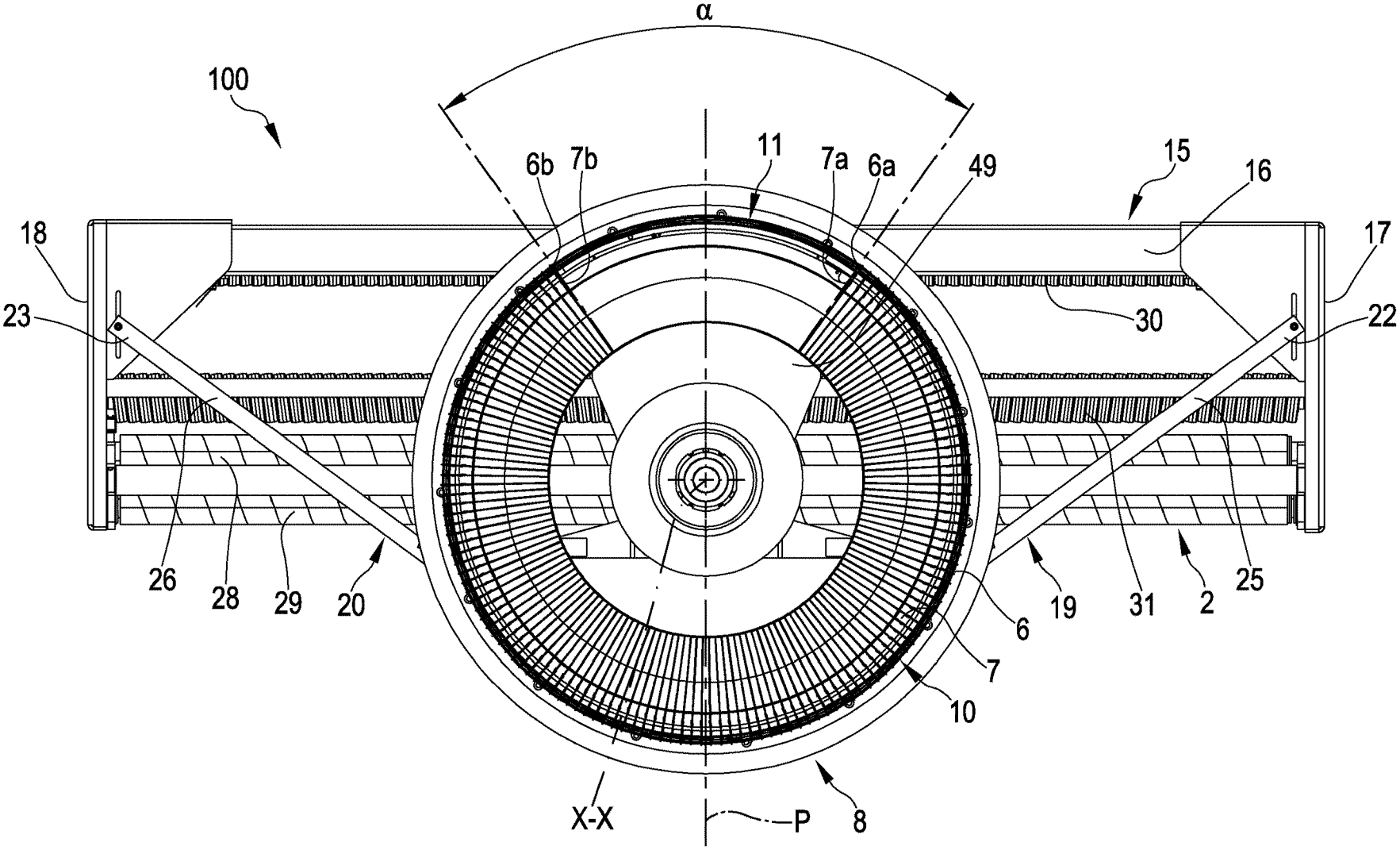
FIG. 5 is a top view of the set as in FIG. 3.
Figure 6:
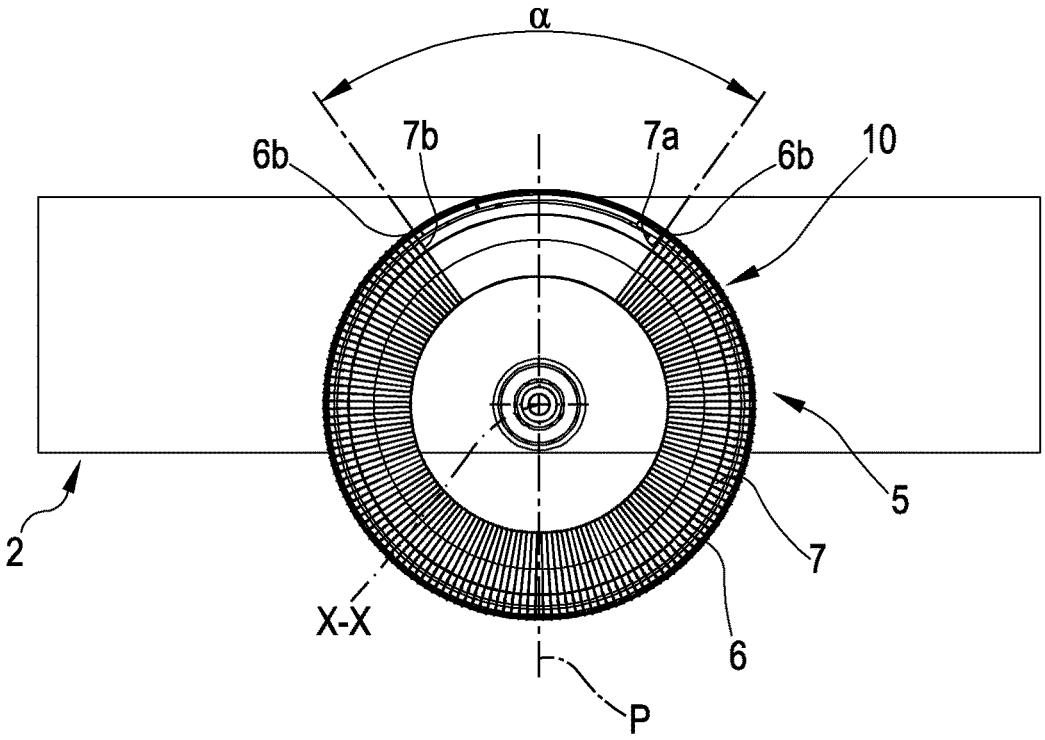
Figure 7:
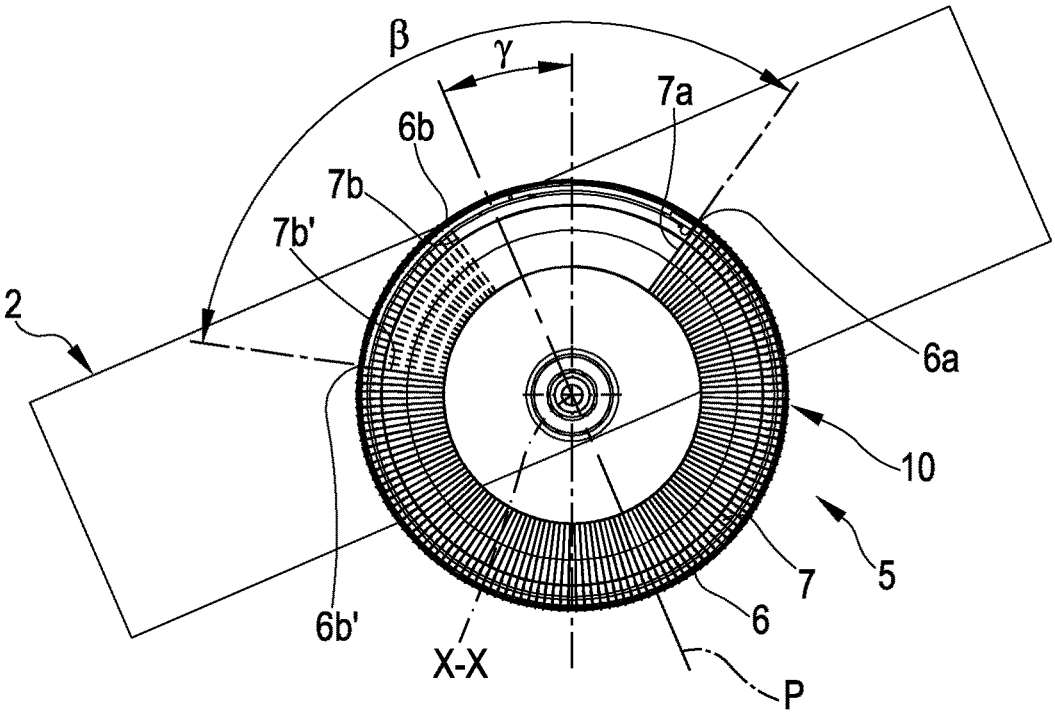
Figure 8:
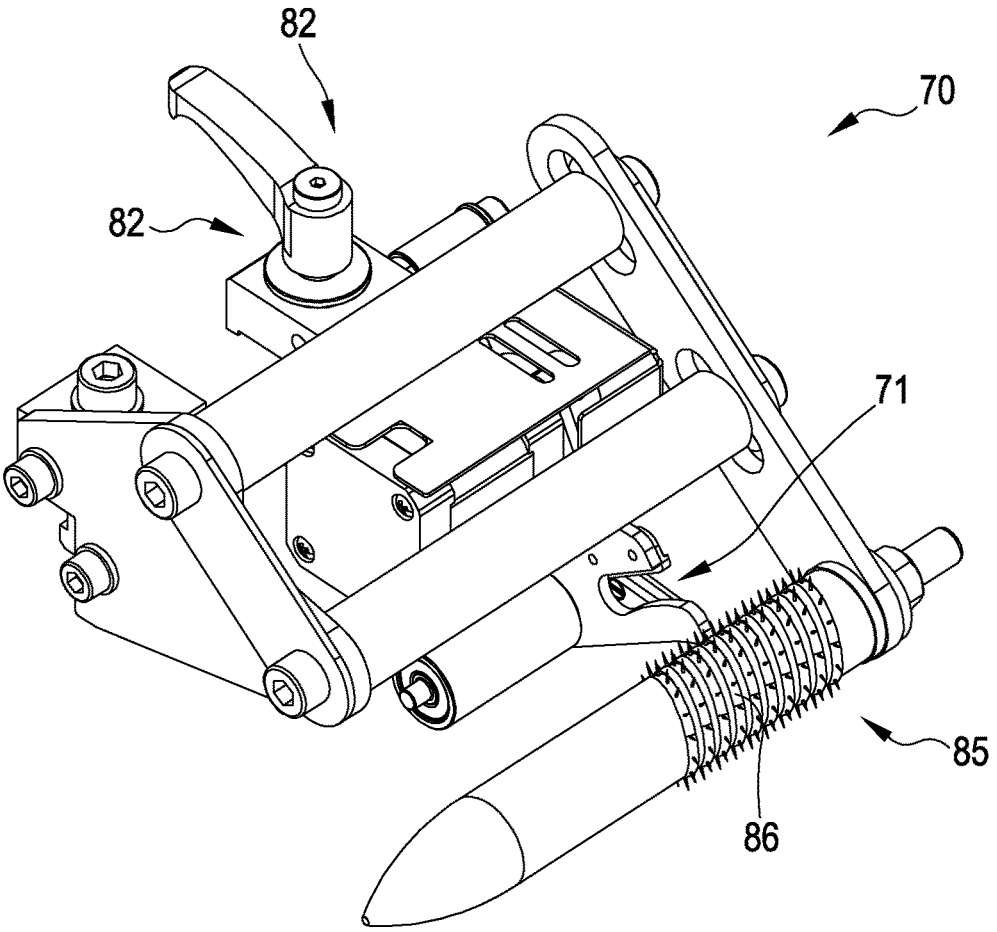
Figure 9:
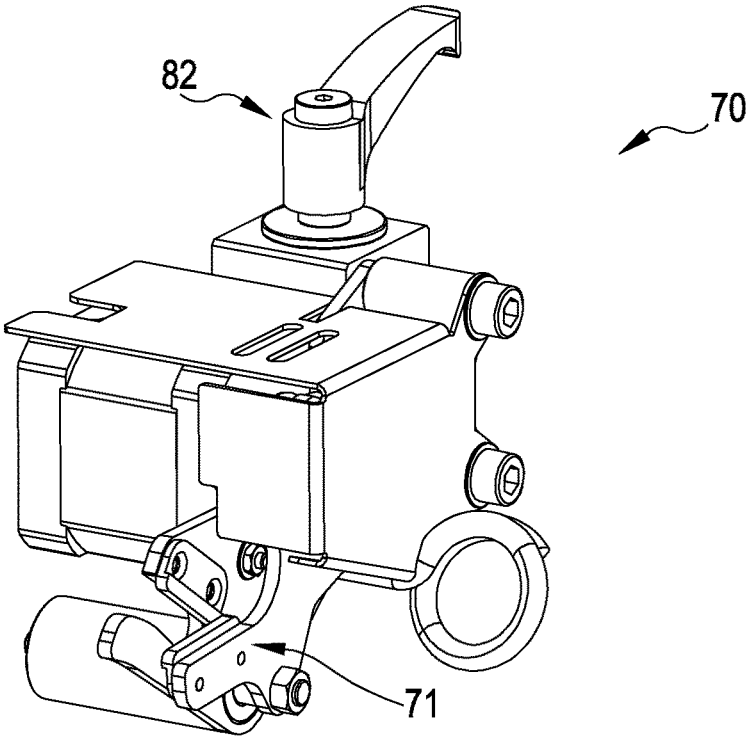
Figure 10:
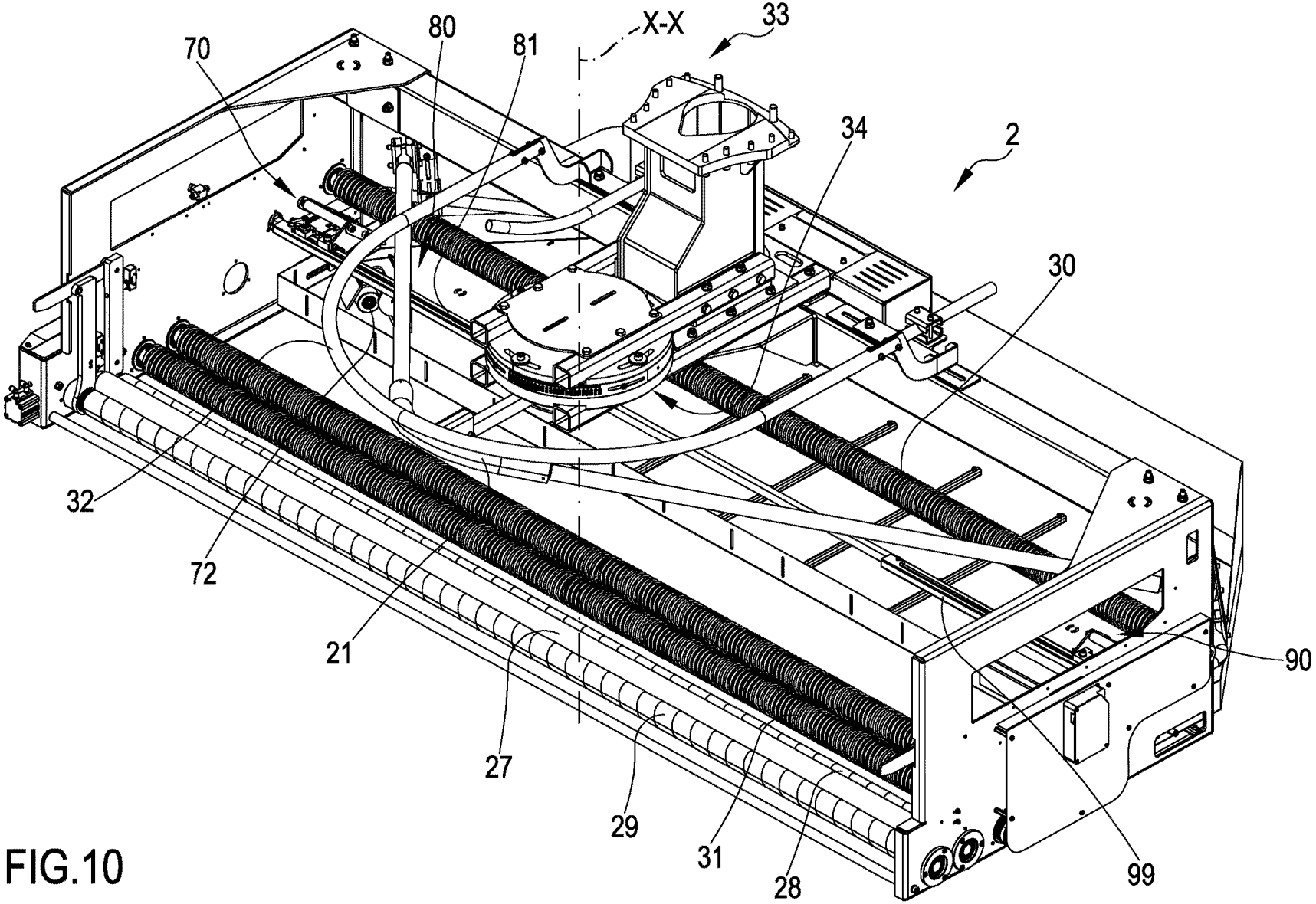
Figure 11:
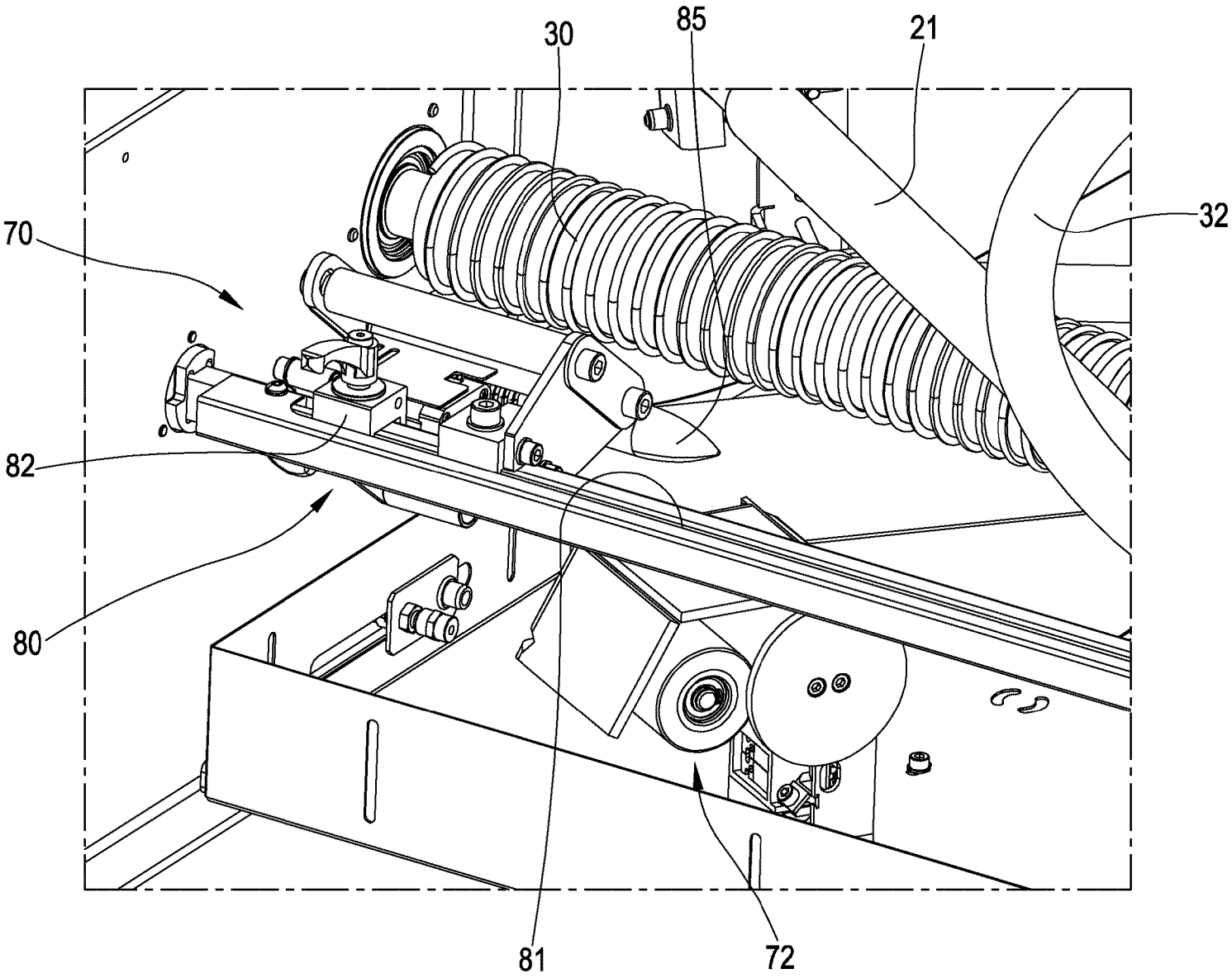
Figure 12:
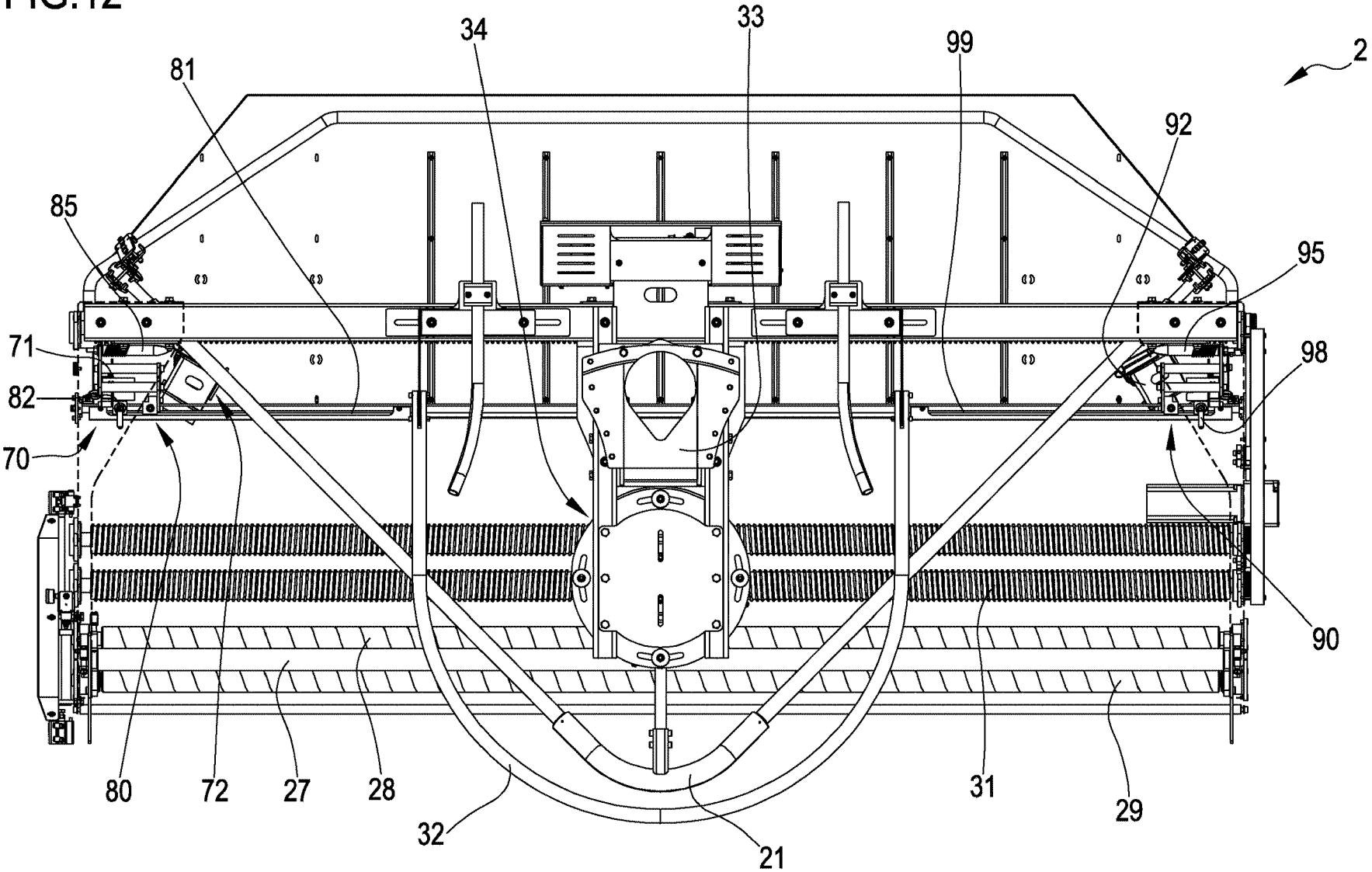
Figure 13:
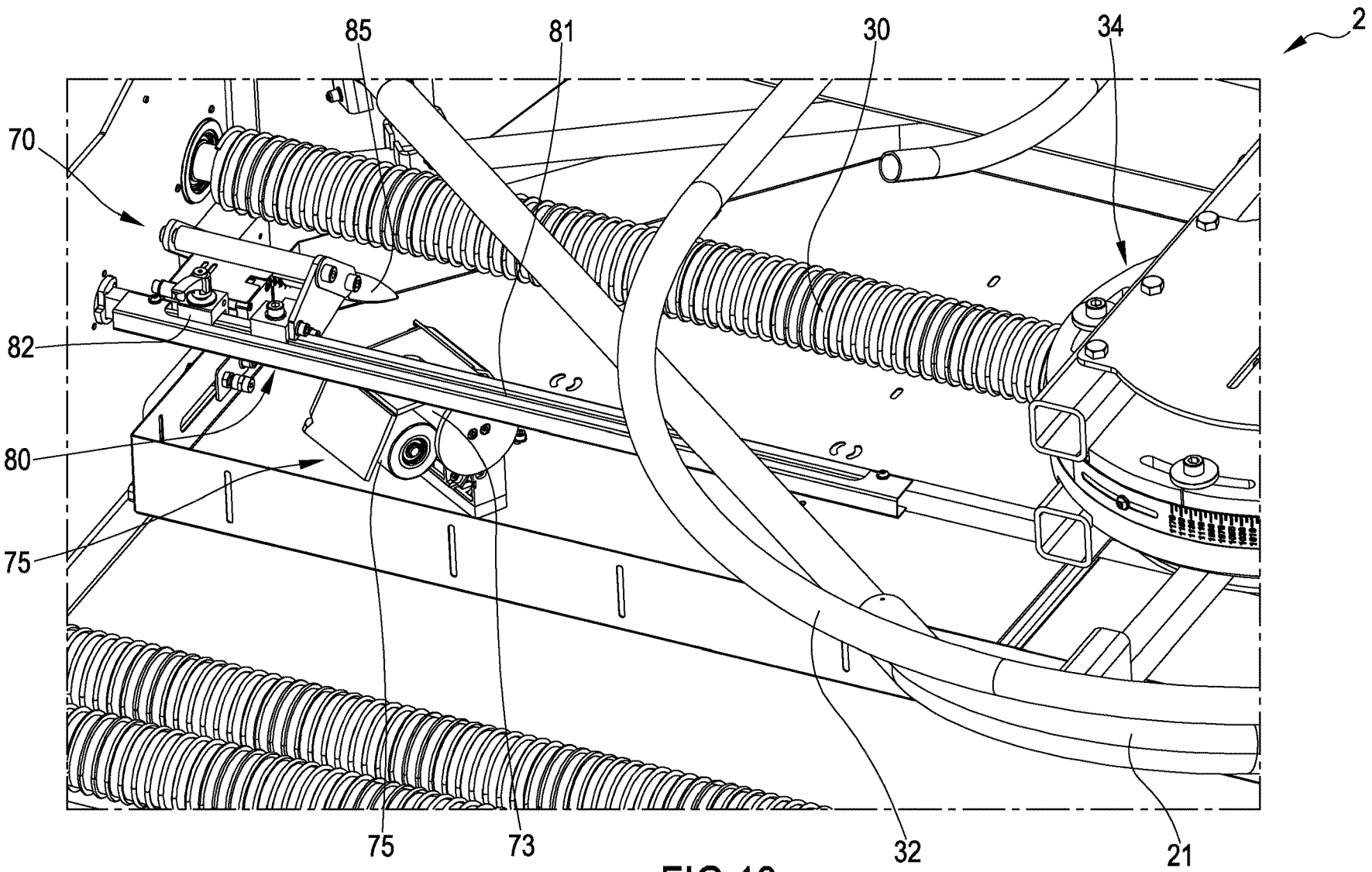
Figure 16:
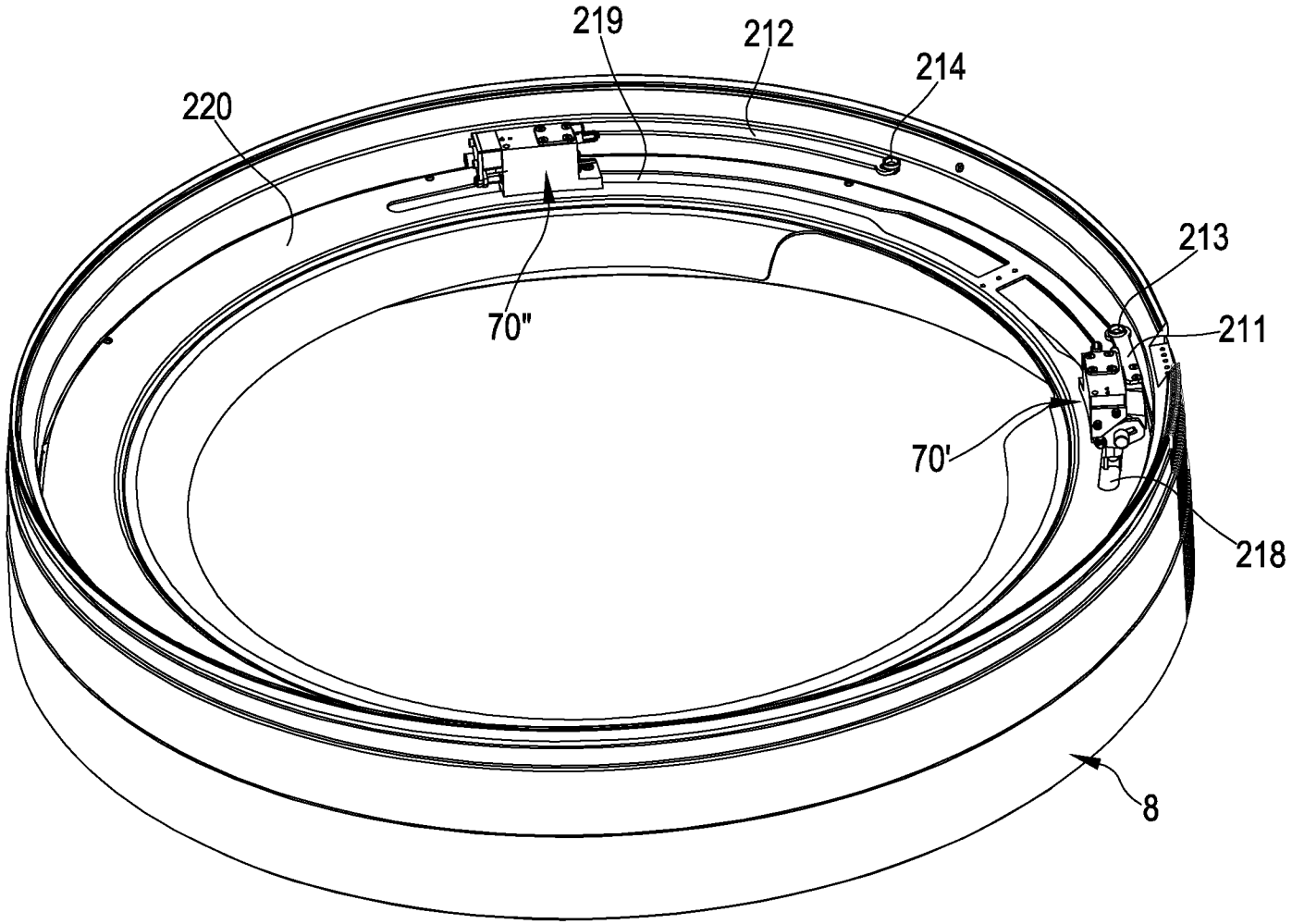
Figure 17:
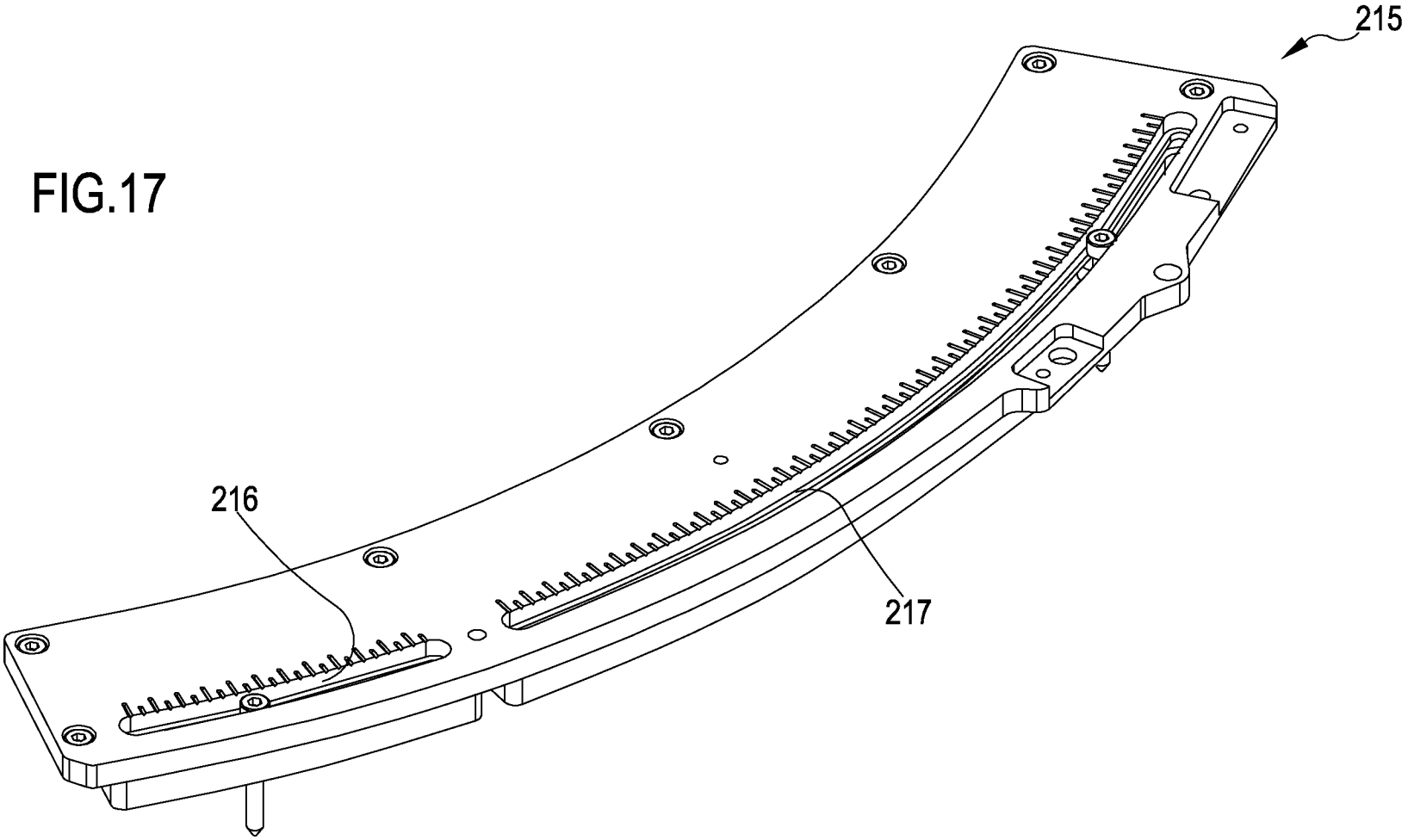
Figure 18:
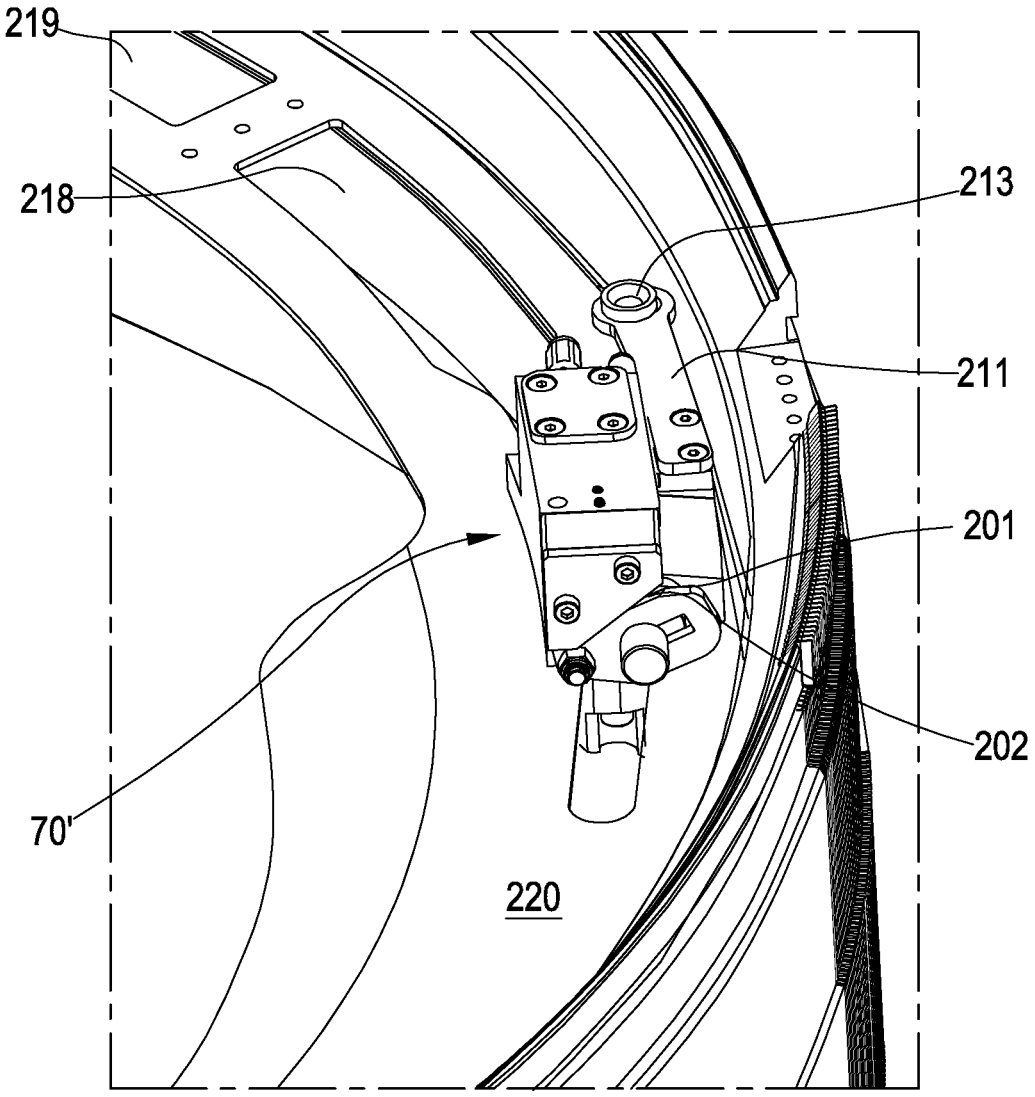
Figure 19:
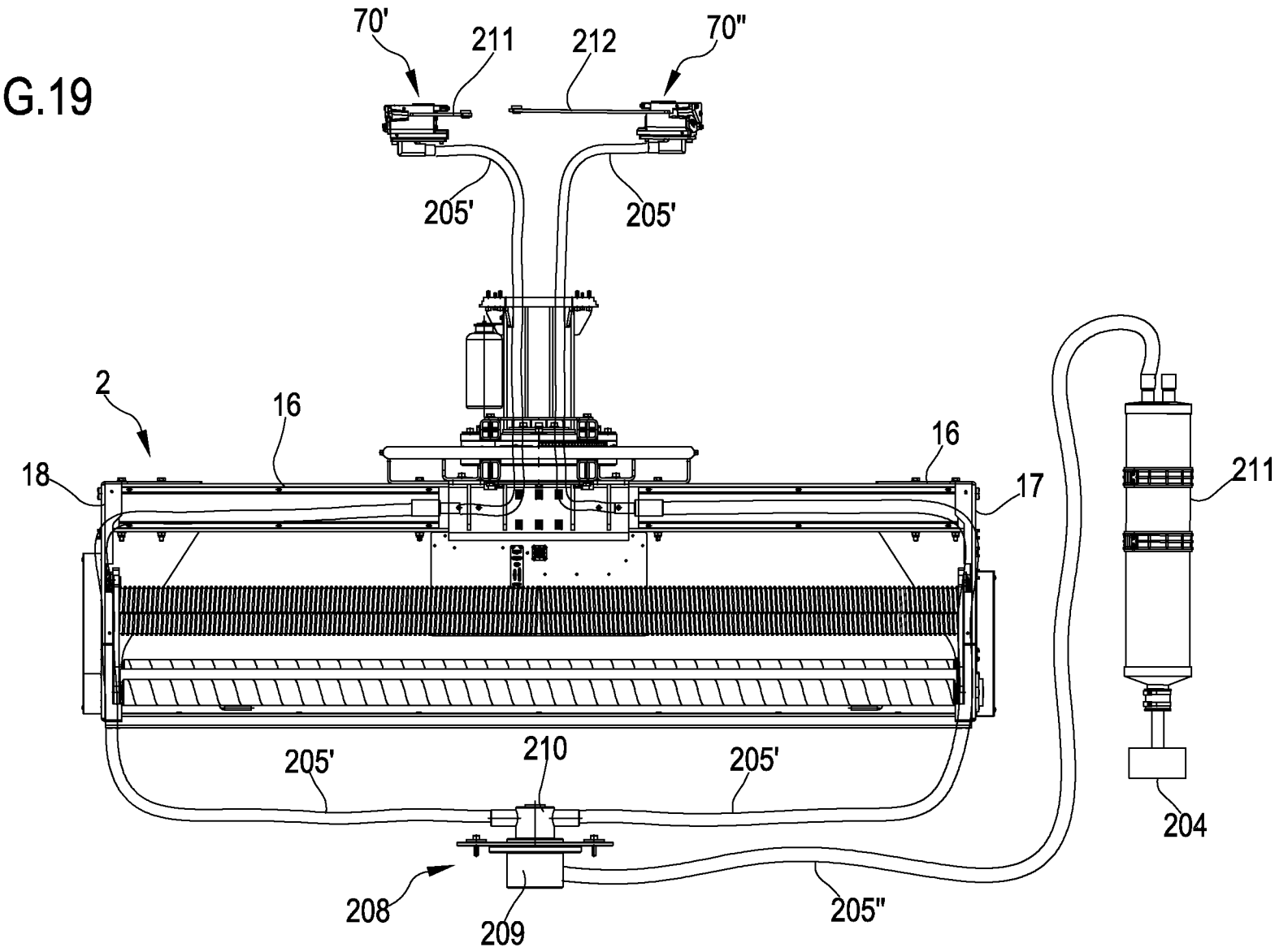
Figure 20:
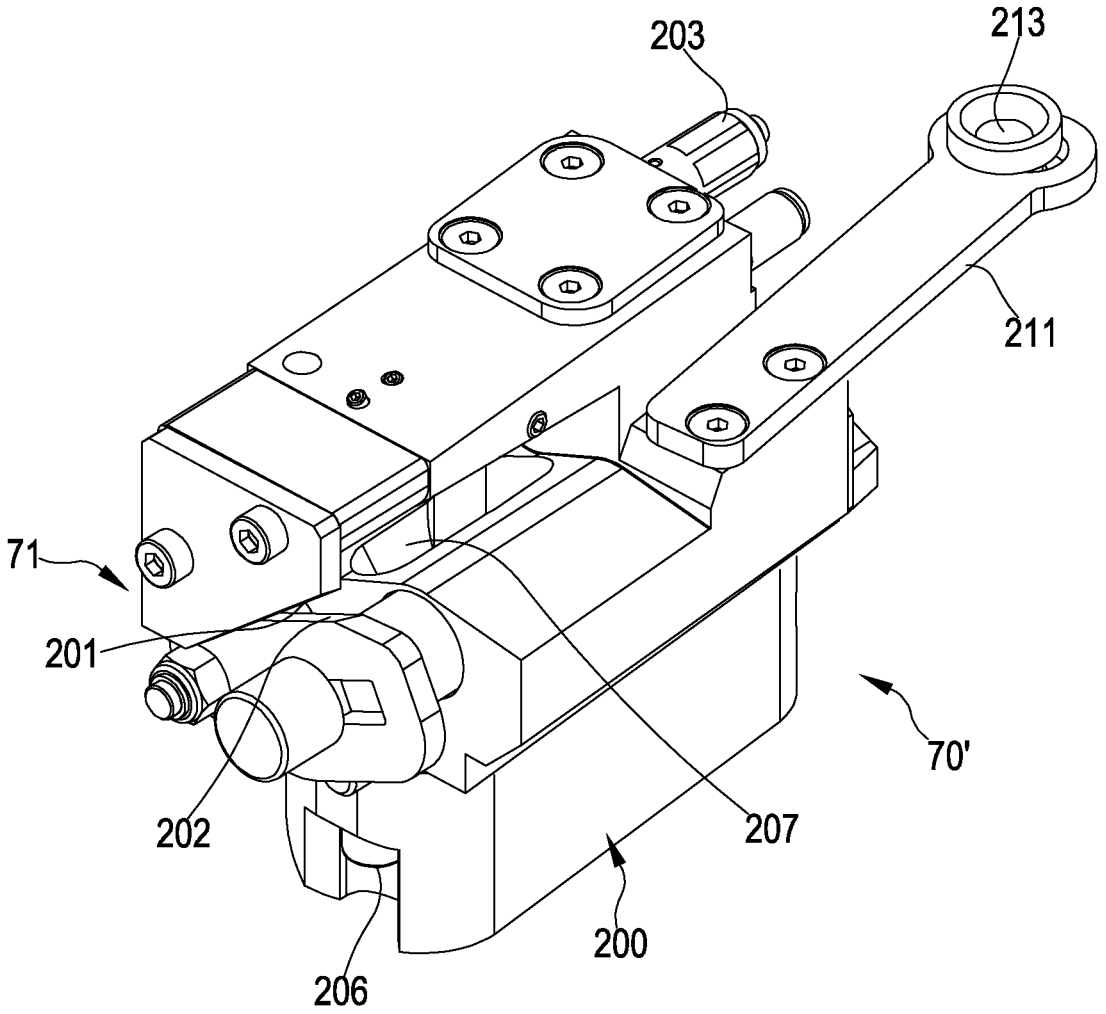
Figure 21:
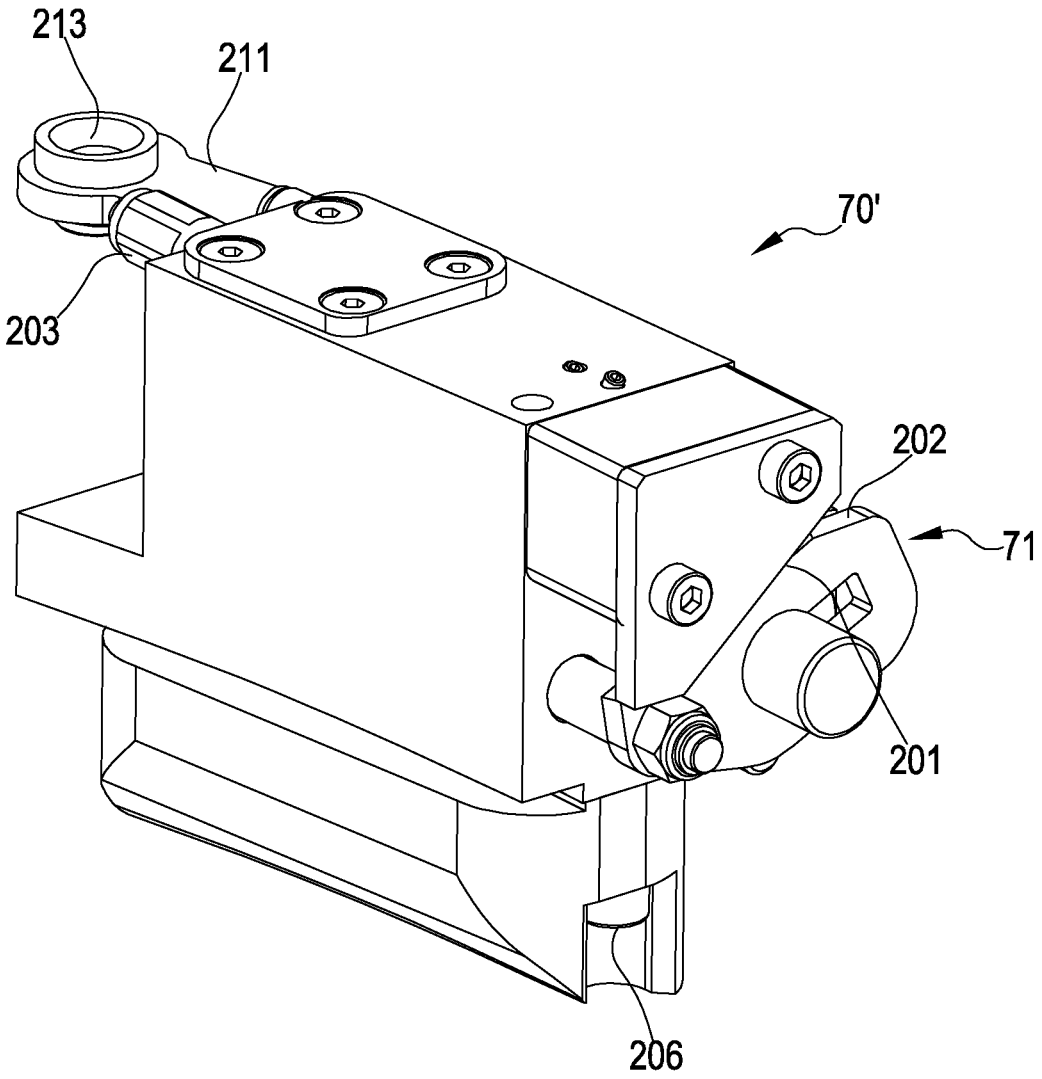

FIGS. 6 and 7 schematically show the view of FIG. 5 with the set in respective operating positions;

FIG. 8 is a perspective view of a possible embodiment of a cutting device for a circular knitting machine according to the present invention;

FIG. 9 is a further perspective view of the cutting device of FIG. 8, with some parts removed;

FIG. 10 is a perspective view of a possible embodiment of a tale-down and/or collecting assembly for a circular knitting machine according to the present invention;

FIG. 11 is a magnified view of a portion of the take-down and/or collecting assembly of FIG. 10;

FIG. 12 is a plan view from above of the take-down and/or collecting assembly of FIG. 10, with some parts removed;

FIG. 13 is a further magnified view of a portion of the take-down and/or collecting assembly of FIG. 10;

FIG. 14 is a magnified view of a further portion of the take-down and/or collecting assembly of FIG. 10;

FIG. 15 is a perspective view of a possible embodiment of a take-down roll of a cutting device for a circular knitting machine according to the present invention;

FIG. 16 shows a cylinder according to a different embodiment of the circular machine according to the invention with some parts removed for better showing others;

FIG. 17 shows a covering lid to be placed on the needle-holding plate of FIG. 2;

FIG. 18 is a magnified view of a portion of FIG. 16;

FIG. 19 is an elevated view of some parts of the circular machine according to the different embodiment;

FIG. 20 shows a cutting device used in the embodiment of FIGS. 16-19;

FIG. 21 shows the cutting device of FIG. 20 from another angle.

Figure 4:
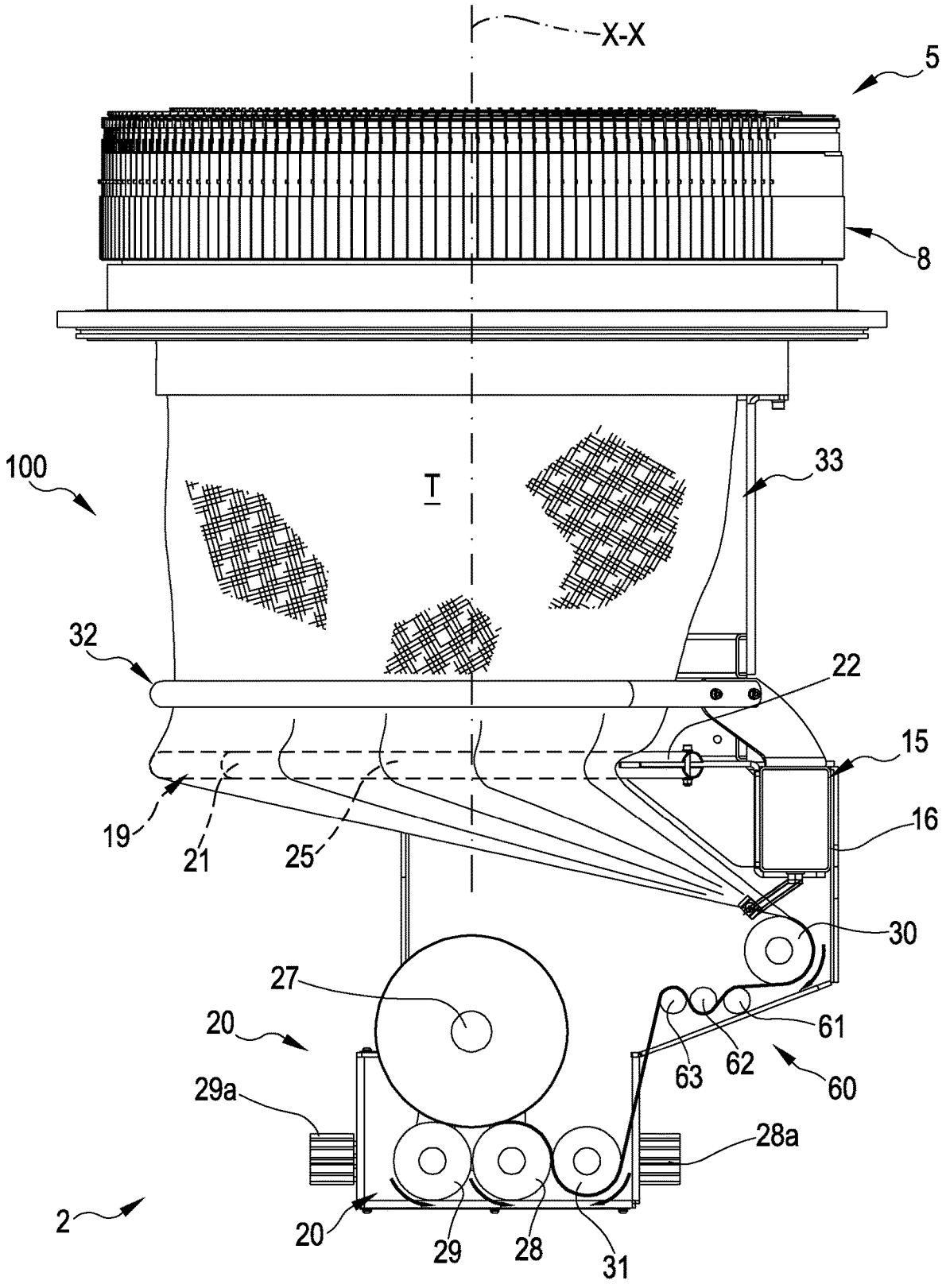
FIG. 4 is a side view of the set as in FIGS. 2 and 3 with some parts removed for better showing others.

With reference to the figures mentioned above, numeral 1 globally refers to an open-type circular knitting machine for the open and width-variable web production with a knitted fabric take-down and/or collecting assembly 2, according to the present invention. A take-down and/or collecting set, comprising this take-down and/or collecting assembly, is globally referred to with numeral 100. In FIG. 4 the assembly 2 schematically shown is a take-down and collecting assembly, since it is provided with take-down elements 60, too. In the examples disclosed below, assemblies performing the take-down function only are not detailed, though they belong to the scope of the present invention.

The circular knitting machine 1 comprises (FIG. 1) a basement 3, which is the supporting structure of the machine 1, and a knitting head 4 mounted onto the basement 3 and provided with a needle-holding element 5, with a plurality of needles 6, 7 movably mounted to the needle-holding element (5), with control means (not shown since of known type, e.g. control cams) apt to selectively actuate the plurality of needles so as to enable the production of a knitted fabric "T". The machine 1 shown is of the type with rotating needle-holding element 5 and non-rotating control means.

As better shown in FIG. 2, the needle-holding element 5 comprises a needle cylinder 8 provided with a first plurality of needles 6 having terminal ends placed on an upper edge of the needle cylinder 8. The needle-holding element 5 further comprises a needle plate 9 provided with a second plurality of needles 7 having terminal ends placed on a radially peripheral edge of said plate 9. Said terminal ends of the needles 6, 7 are directed towards an operating zone 10 (FIG. 2) in which occurs the formation of the knitted fabric "T", which then gets down into the needle cylinder 8.

The machine 1 shown according to the invention is of the type for the open and width-variable web production. As a matter of fact, the needles 6, 7 are arranged in series on the needle-holding element 5 (in particular on the needle cylinder 8 and on the needle plate 9) along respect paths shaped as an arc of circle smaller than 360°, as can be seen schematically in FIGS. 5, 6 and 7. In other words, the operating zone 10 is an arc of circle. A first needle 6*a* and a last needle 6*b* of the first plurality of needles 6 delimit in between a zone 11 without needles. In the embodiment shown (FIG. 5), this zone 11 without needles develop on angle "α" of about 40°. Similarly, a first needle 7*a* and a last needle 7*b* of the second plurality of needles 7 of the needle plate 9 delimit in between a zone without needles placed on the zone 11 without needles of the needle cylinder 8. The whole circumference of the needle-holding element 5 is therefore divided into the operating zone 10 shaped as an arc of circle, in which the fabric "T" is formed, and into a complementary zone 11, known as "dead zone", in which the fabric "T" is not formed. The fabric "T" thus formed therefore has the shape of a cylinder with a partial circumferential development, i.e. open on the dead zone.

The machine 1 further comprises devices (known per se and not shown) for varying the number of active needles 6, 7 both of the needle cylinder 8 and of the needle plate 9 so as to widen the dead zone 11 and thus reduce the operating zone 10 and vary in this manner the width of the knitted fabric "T" produced. The needles 6, 7 can be made inactive, e.g. not actuating them and/or moving them away from the operating zone 10 and/or dismounting them. The needles 6, 7 can be made inactive starting from the last needle 6*b* (FIGS. 5, 6 and 7). In FIG. 6, the dead zone has a width "α" and the fabric "T" is thus formed on the operating zone 10 defined by the arc of circle between the last needle 6*b*, 7*b* and the first needle 6*a*, 7*a*. In the example shown in FIG. 7, the dead zone, which in FIG. 6 has a width "α", is widened by reducing the number of active needles starting from the last needle 6*b*, until a width "β" is achieved (FIG. 7). In FIG. 7 the last active needle 6*b*' is no longer the last needle 6*b* close to the zone without needles 11. All the needles 6 between the one referred to with numeral 6*b*' and the last one 6*b* are made inactive. The fabric "T" is thus formed on the operating zone 10 defined by the arc of circle between the last active needle 6*b*', 7*b*' and the first needle 6*a*, 7*a*.

During the formation of the knitted fabric "T", the needle-holding element 5 of the machine 1 rotates continuously around a central axis "X-X" and suitable devices (known per se and not shown) allow at each revolution to begin thread feeding on the first active needles 6*a*, 7*a* (of the operating zone 10) and to interrupt feeding on the last active needle (6*b* or 6*b*').

The basement 3 comprises an upper ring or supporting element 12 (FIGS. 1 and 2), onto which the knitting head 4 is mounted so that the needle-holding element 5 can rotated with respect to said upper supporting element 12 around said central axis "X-X" and comprises a lower base 13, or cross joint, designed to be laid onto the ground. The upper supporting element 12 and the needle-holding element 5 are coaxial with the central axis "X-X". The basement 3 further comprises two supporting feet 14. A motor, not shown, moves in rotation the needle-holding element 5.

Between the upper ring 12 and the lower base 13 a collecting space without elements of the basement 3 is defined, which is designed to house the collecting assembly 2 for the fabric produced by the machine 1.

The collecting assembly 2 shown is hung to the needle-holding element 5 and supported by the latter. During the production of the fabric "T" it rotates integrally with the needle-holding element 4 in the collecting space. In other embodiments, not shown, the take-down and/or collecting assembly 2 is not hung to but rests on the ground or the basement 3 and is anyhow operatively connected to the needle-holding element 5 so as to rotate integrally with the latter during production.

The collecting assembly 2 shown (which can be seen better in FIGS. 4 and 5) comprises a supporting structure 15 defined by a beam 16 and by two side plates 17, 19 developing from opposite ends of the beam 16 and orthogonal thereto. The side plates 17, 18 are parallel and face each other. The beam 16 develops perpendicular to the central axis "X-X". The collecting assembly 2 is symmetrical with respect to a plane of symmetry "P" (FIGS. 5, 6 and 7) containing the central axis "X-X".

The supporting structure 15 supports spreading devices 19 configured for opening and stretching in a single layer the knitted fabric "T" produced by the knitting head 4, and devices for piling up 20 the knitted fabric "T" once stretched.

The spreading devices (FIGS. 3 and 4) comprise a spreading bar 21 mounted, preferably in a fixed manner, onto the supporting structure 15 and configured for causing two side edges of the fabric "T" to open by progressively moving away from each other. The spreading bar 21 extends longitudinally between two of its terminal ends 22, 23, each one being firmly connected to a respective side plate 17, 18, of the supporting structure 15. The spreading bar 21 is placed opposite the beam 16 and basically extends on the whole length of said beam 16. The spreading bar 21 shown has a curved shape defined by a central portion 24 and by two side portions 25, 26. The two side portions 25, 26 progressively move away from the beam 16 and converge towards the central portion 24, which has a maximum distance from the beam 16 and is apt to guide a central portion of the knitted fabric "T" when coming down. The spreading bar 21 preferably has global shape as a rounded "V", i.e. its central portion 24 is curved, e.g. as an arc of circle, and its two portions 25, 26 are rectilinear. The spreading bar 21 is basically symmetrical with respect to a vertical plane of symmetry "P" containing the central axis "X-X" of the needle-holding element 5 and is arranged in a horizontal plane. The spreading bar 21 is mounted onto the supporting structure 15, e.g. by means of slides placed and the terminal ends 22, 23, so as to adjust the distance of the central portion 24 from the beam 16.

Figure 1:
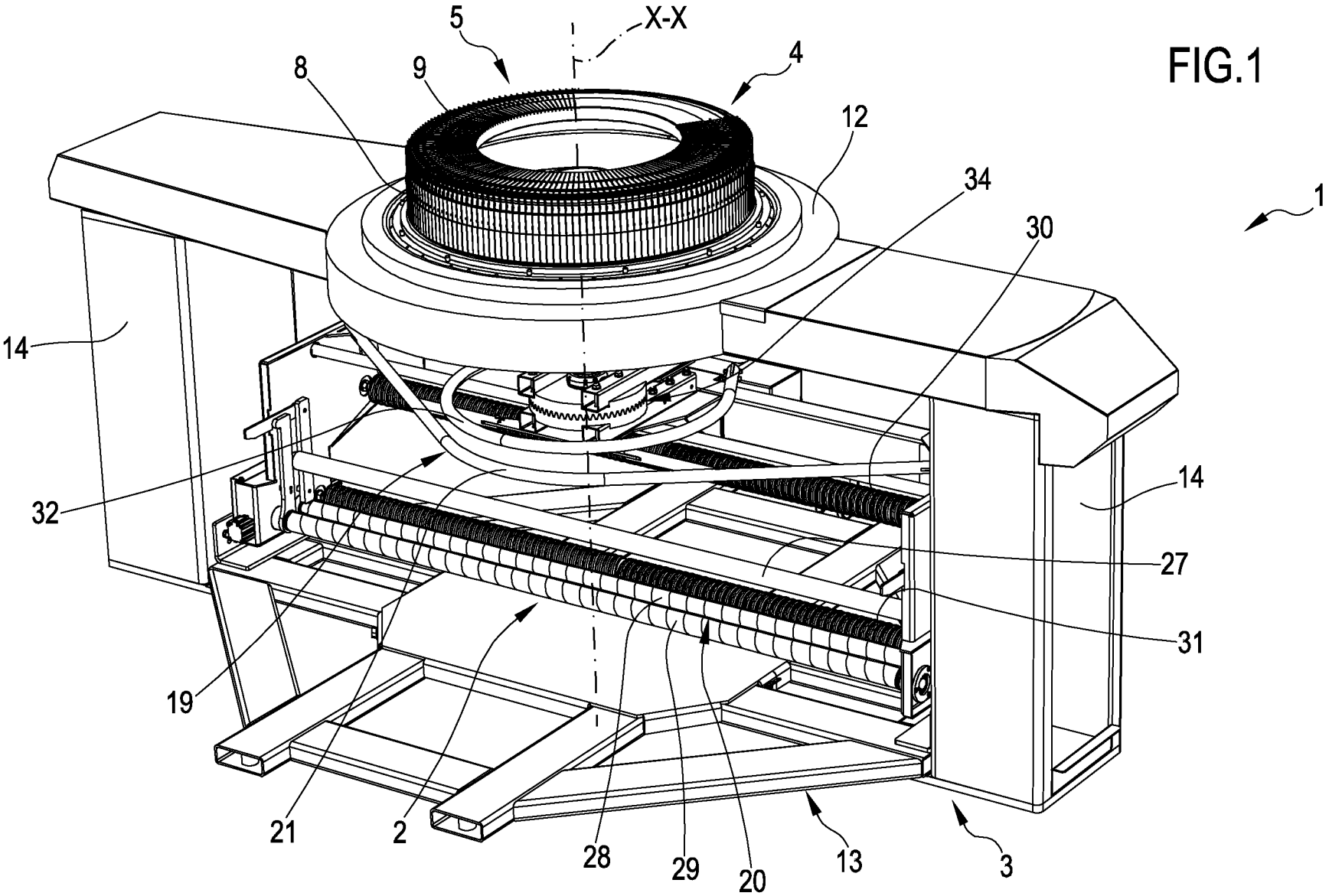
FIG. 1 shows an open-type circular knitting machine for the open and width-variable web production with a knitted fabric take-down and/or collecting assembly according to the present invention.
Figure 3:
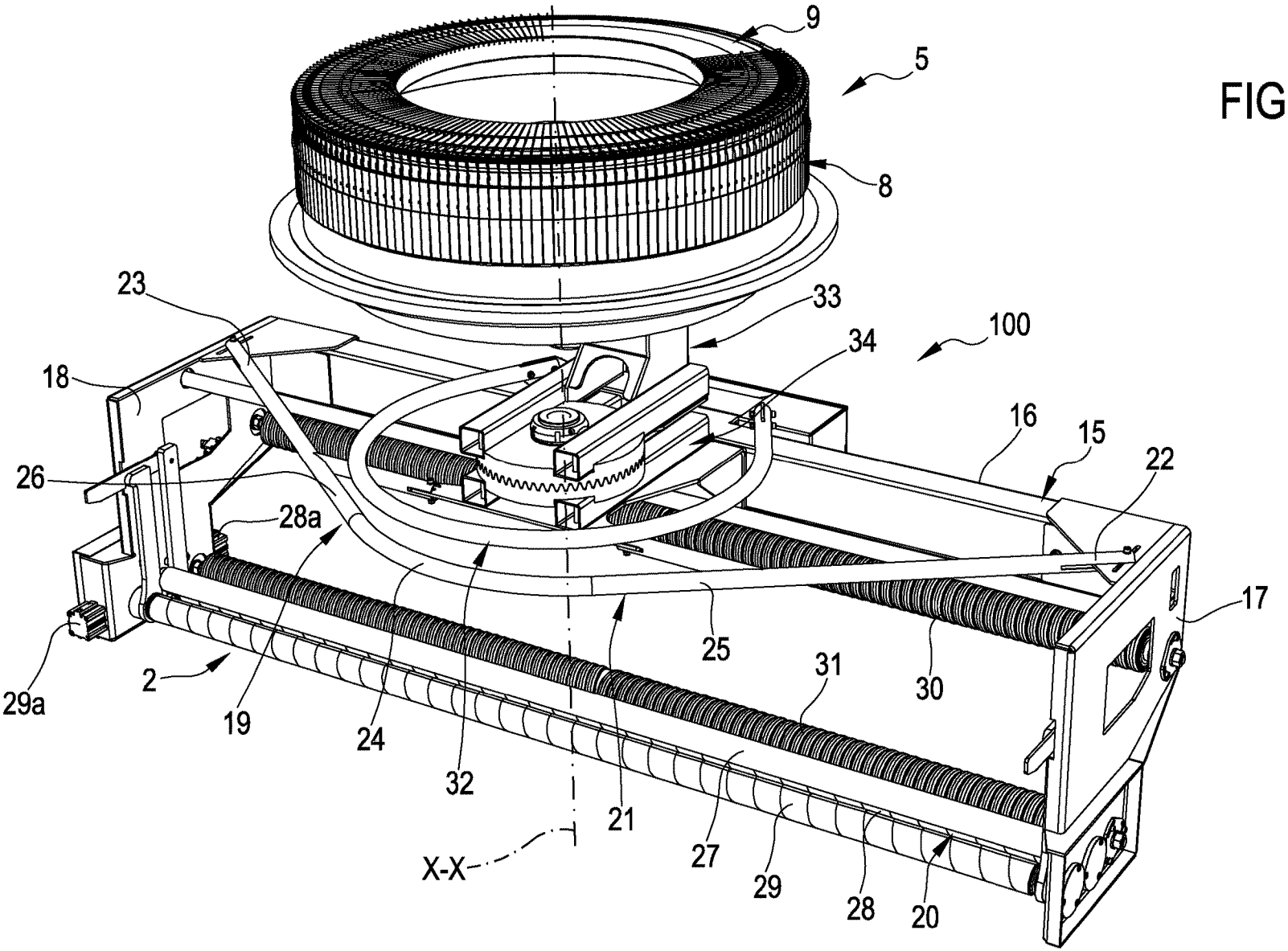
FIG. 3 shows a perspective view of a collecting set associated to a needle-holding element belonging to the machine of FIG. 1.

The supporting structure 15 also supports the devices for piling up 20 the knitted fabric "T" stretched, which are placed below the spreading devices 19, i.e. downstream from the spreading devices 19 with respect to a feeding direction of the fabric "T" coming from the knitting head 4. The piling-up devices 19 are defined by a collecting roll 27 (or fabric roller) with rectilinear axis (FIGS. 1, 3 and 4). The collecting roll 27 is turnably mounted onto the supporting structure 15 so as to freely rotate around a respective, basically horizontal axis of rotation. The collecting roll 27 is designed to collect the knitted fabric "T" produced by the machine 1 as a bobbin, winding it thereon and in a single continuous layer. The collecting roll 27 extends between two of its terminal ends, on which it is turnably connected to the aforesaid side plates 17 and 18. The axis of rotation of the collecting roll 27 is preferably oriented parallel to the longitudinal development of the beam 16, i.e. orthogonal to the plane of symmetry of the spreading bar 21.

The piling-up devices 20 comprise a first and a second winding roller 28, 29 turnably mounted onto the supporting structure 15 so as to rotate around respective axes of rotation that are basically horizontal and moved in rotation by respective motors 28*a*, 29*a* (FIGS. 3 and 4). The winding rolls 29 extend between two of their longitudinal ends, on which they are turnably connected to the aforesaid side plates 17 and 18. The axes of rotation of the winding rolls 28, 29 are oriented parallel to the longitudinal development of the beam 16. The first and the second winding roll 28, 29 are placed below the collecting roll 27 and both act along respective contact lines upon the fabric wound as a bobbin onto the collecting roll so as to impart a rotation thereto and cause the knitted fabric "T" to be continuously wound onto the collecting roll 27. The winding rolls 28, 29 cannot move whereas the collecting roll 27 is free to vertically move on dedicated guides. The collecting roll 27 rests on the winding rolls 28, 29 and, while collecting the fabric produced as the bobbin diameters increases, vertically moved within the guides.

The collecting assembly 2 comprises a first unfolding roll 30 configured for interacting with the fabric "T" moving towards the collecting roll 27 so as to stretch it horizontally by spreading it towards two side ends of the first unfolding roll 30. The first unfolding roll 30 is mounted above the winding rolls 28, 29 and is placed close to the beam 16. The first unfolding roll 30 is turnably mounted onto the supporting structure 15 so as to freely rotate around a respective, basically horizontal axis of rotation. The first unfolding roll 30 extends between two of its terminal ends, on which it is turnably connected to the aforesaid side plates 17 and 18. The axis of rotation of the first unfolding roll 30 is oriented parallel to the longitudinal development of the beam 16. With reference to the path of the fabric "T" during production, the first unfolding roll 30 is placed downstream from the spreading bar 21 and upstream from the winding rolls 28, 29.

A second unfolding roll 31 is positioned close to the first winding roll 28. The second unfolding roll 31 is turnably mounted onto the supporting structure 15 so as to freely rotate around a respective, basically horizontal axis of rotation. The second unfolding roll 31 extends between two of its terminal ends, on which it is turnably connected to the aforesaid side plates 17 and 18. The axis of rotation of the second unfolding roll 31 is oriented parallel to the longitudinal development of the beam 16. With reference to the path of the fabric "T" during production, the second unfolding roll 31 is placed downstream from the first unfolding roll 30 and upstream from the winding rolls 28, 29.

The collecting assembly further comprises a guiding ring 32 mounted, preferably in a fixed manner, onto the supporting structure 15 above the spreading bar 21. The guiding ring 32 is arranged in a basically horizontal plane and is configured for guiding the fabric "T" produced by the machine 1 when coming down directly as a single layer from the needle-holding element 5, towards the spreading bar 21. The guiding ring 32 delimits inwardly a passage in which said fabric "T" gets down, sliding on a radially inner surface of said guiding ring 32. The guiding ring 32 is apt to guide and unfold the fabric "T". The guiding ring 32 laterally extend from the same front side of the beam 16 from which also the spreading bar 21 laterally extends, and it partially overlaps said spreading bar 21. The guiding ring 32 has a basically circular shape and is basically coaxial with the needle-holding element 5. The guiding ring 32 is fixed on a central portion of the beam 16. In the embodiment shown, the guiding ring 32 does not define a complete circle but is formed by a curved bar whose ends are firmly connected to the beam 16.

The knitted fabric "T", coming from the operating zone 10 of the needle-holding element 5, gets down into the needle-holding element 8 shaped as an incomplete tube, through the guiding ring 32 as an incomplete tube and then outside the spreading bar 21 opening and unfolding itself. Then the knitted fabric "T", now completely open in a single layer, is partially wound onto the first unfolding roll 30 and reaches the second unfolding roll 31 onto which it is partially wound by getting below the latter. Eventually, the knitted fabric "T" is wound as a bobbin onto the collecting roll 27 thanks to the rotation of the winding rolls 28, 29.

A supporting frame 33 is firmly connected to the supporting structure 15 and connects the collecting assembly 2 to the needle-holding element 5, in particular with the needle cylinder 8 (FIGS. 3 and 4). In the embodiment shown, the supporting frame 33 has a box-shaped structure removably joined to the needle cylinder 8, e.g. by means of screws or bolts, or welded thereto.

Between the supporting frame 33 and the supporting structure 15 of the collecting assembly 2 are operatively placed devices 34 for adjusting the angular position of the collecting assembly 2 with respect to the needle-holding element 5 around the central axis "X-X" (FIGS. 1, 3 and 4).

In one embodiment, schematically shown in FIG. 4, the assembly 2 is a take-down and collecting assembly and can further comprise take-down elements 60 which cause the knitted fabric "T" to get down under tension into the collecting space. In the example shown, the take-down elements 60 comprise several take-down rolls, placed in series one to the other, acting upon the fabric "T" so as to force the advancement thereof towards the collecting roll 27. FIG. 9 shows by way of example three take-down rolls 61, 62 ad 63, which are placed in series one to the other and which the fabric "T" gets through sequentially. The take-down rolls 61, 62, 63 are placed, with respect to the direction of advancement of the fabric "T", between the first spreading roll 30 and the second spreading roll 31. The collecting rolls 61, 62, 63 are turnably mounted onto the supporting structure 15 so as to freely rotate around respective axes of rotation which are basically rectilinear, horizontal and parallel to the collecting roll. Each one of the take-down rolls 61, 62, 63 extends between two of its longitudinal ends, on which it is turnably connected to the aforesaid side plates 17 and 18. The piling-up devices 20, the spreading devices 19 and the take-down elements 60 are integral with each other in the rotation around the central axis "X-X" (both during adjustment and during production).

The machine 1 further comprises an electronic control unit, not shown, for managing its operations.

In one embodiment in which the adjusting devices 34 are motorized, the electronic control unit is operatively connected to the motor or motors of said devices 34 and is configured for controlling the motor or motors based on input data related to the desired angular position of the collecting assembly 2. The operator can e.g. insert the desired angular value into the control unit by means of input devices (keyboard, touchscreen, mouse, etc.) and the control unit controls the motor so that it moves the collecting assembly accordingly. In a variant of embodiment, the electronic control unit is configured for receiving as input, instead of the desired angular value, a value related to the desired fabric width, such as the width of the dead zone or the number of active needles or the number of deactivated needles, and for controlling the motor or motors accordingly so that it moves/they move the collecting assembly accordingly.

In another variant of embodiment, the electronic control unit is operatively connected to the devices for varying the number of active needles and is configured for receiving as input a value related to the desired fabric width, for calculating the number of active needles required for obtaining this width, for controlling the devices for varying the number of active needles so that they activate the required needles, and for controlling the motor or motors so that it moves/they move the collecting assembly accordingly.

In another variant of embodiment in which the adjusting devices 34 are manual, the electronic control unit is operatively connected to the devices for varying the number of active needles and is configured for receiving as input a value related to the desired fabric width, for calculating the number of active needles required for obtaining this width, for controlling the devices for varying the number of active needles so that they activate the required needles, and for providing as output (e.g. on a screen) the angular position of the collecting assembly (which is then adjusted manually).

The collecting assembly 2, the adjusting devices 34 and the supporting frame 33 make a collecting set according to the present invention, which can be firmly connected to the knitting head of a circular machine, even if already existing (retrofitting).

During use, the machine 1 is previously set so as to produce a fabric "T" having a predefined width. To this purpose, the operator sets the width of the operating zone 10 (and thus of the dead zone 11) by activating or deactivating a given number of needles 6, 7. Then, by acting upon the adjusting devices 34 according to the above description, it adjust the angular position of the collecting assembly 2 accordingly, so as to angularly center the collecting assembly 2 with respect to the dead zone 11 (i.e. with respect to the operating zone 10). Starting from the situation shown in FIG. 6, in which all the needles 6 present are active and the plane of symmetry "P" of the collecting assembly 2 is centered with respect to the zone 11 without needles (and thus with respect to the operating zone 10 and to the knitted fabric "T" produced), the operator deactivates a plurality of needles 6 starting from the last needle 6*b* adjacent to the zone without needles 11 as far as the needle referred in FIG. 7 with numeral 6*b*'. The dead zone of FIG. 7 (made up of the zone without needles and of inactive needles) is thus wider than the one in FIG. 6. In order to center again the collecting assembly 2 with respect to the new dead zone 11, the operator rotates said collecting group 2 of an angle "γ". Now the operator can begin production.

According to a preferred embodiment of the present invention, shown in FIGS. 8-15, the circular knitting machine 1 comprises a take-down and/or collecting assembly 2 for the knitted fabric T under production, arranged downstream from the knitting head 4 with respect to a feeding direction of the fabric T under production.

The take-down and/or collecting assembly 2 is configured for rotating integrally or in a coordinated manner with the aforesaid needle-holding element 5 during the production of the knitted fabric T. This embodiment of the take-down and/or collecting assembly, shown by way of example, is different from the one in FIGS. 1-7 but has similar components, which are referred to—where required—with the same numerals.

In this embodiment, the take-down and/or collecting assembly 2 is characterized in that it comprises at least a first cutting device 70, operatively associated with the take-down and/or collecting assembly and configured for progressively cutting the produced fabric so as to divide it into at least two distinct webs.

In other words, the cutting device acts upon the fabric produced in open mode and divides it into two distinct webs, each having a respective width, based on the position of the cutting device with respect to the fabric itself.

In a possible, particularly relevant application, the first cutting device 70 is configured for progressively cutting a first selvedge of the open knitted fabric, so that the aforesaid two distinct webs correspond to the first selvedge and to a fabric web without the first selvedge. In this case, the produced fabric is cut on an edge thereof and the two distinct webs therefore consist of a selvedge and of the whole remaining fabric.

Typically, the cutting device 70 or "cutter" is integral with the take-down and/or collecting assembly and rotates with it during the production of the fabric T.

The cutting device 70 comprises a cutting element 71 configured for cutting the knitted fabric (preferably, though not necessarily, for cutting the first selvedge). This cutting element 71 is preferably a blade or a pair of scissors (as in the embodiment shown by way of example in the figures) or an ultrasonic cutting element or a heating cutting element, or also a different element which is able to cut the selvedge.

Preferably, the cutting device 70 comprises a take-down roll 72 configured for receiving the selvedge cut by the cutting element 71, for taking it away from the cutting element itself and for maintaining it stretched.

The take-down roll can be integral or made jointly with the cutting device, or (as in the embodiment shown in the figures) it can be distinct and slightly distanced from the latter though configured for receiving the cut selvedge and stretching it.

As shown by way of example in FIG. 15, the take-down roll 72 can comprise a pair of rolls, of which a first roll (referred to with 73) is actuated by means of a rotating motor 74 (e.g. an electric or a pneumatic motor), and a second roll 75 can rotate freely. Preferably, the two rolls have parallel axes and are one beside the other so as to define therebetween a thin passage for the cut selvedge. Preferably, the second roll is set into rotation by the first one through a contact resulting from the selvedge in the aforesaid passage.

Preferably, as shown in the figures, the cutting device 70 is arranged upstream, preferably immediately upstream, from the collecting roll 27.

Thus, the cutting device 70 intercepts the fabric before it is wound onto the collecting roll 27 and cuts the selvedge (which is taken away, preferably by means of the take-down roll). Once the selvedge is cut, the fabric can go further and reach the collecting roll, onto which it is wound in an orderly and uniform manner.

Preferably, the take-down and/or collecting assembly 2 comprises first mounting elements 80 configured for enabling the positioning and mounting of the first cutting device 70 into the take-down and/or collecting assembly itself.

The mounting elements 80 comprise a rectilinear guide 81 (FIGS. 10, 11, 12, 13 and 14) developing parallel to an axis of development of the collecting roll 27 and configured for housing the cutting device and selectively placing it in a given position with respect to the fabric produced by the knitting machine (and therefore to the collecting roll). Preferably, the selection of the given position of the cutting device occurs by moving the latter (along the guide) parallel to the collecting roll and beside the latter (as can be seen e.g. in FIGS. 4, 5 and 6).

The mounting elements 80 comprise a hooking device 82 associated with the cutting device 70 and configured for enabling a manual, reversible mounting of the cutting device to the rectilinear guide 81 in a given position, along the guide, which can be selected based on the width of the operating zone provided with active needles, i.e. based on the width of the fabric web under production or, more generally, based on the position in which the produced fabric has to be cut so as to be divided into the aforesaid two distinct webs. Thus, based on the number of active needles, which defines the width of the fabric T, or based on the size of the webs into which the fabric needs to be divided, the cutting device can be accurately positioned so as to correctly cut the knitted fabric for removing the selvedge or for making two webs.

In a possible embodiment, which is not shown, the mounting elements can comprise, in addition or as an alternative to the hooking device, a positioning device acting upon the cutting device and configured for enabling an automatic selection of the position of the cutting device along the rectilinear guide, preferably based on the width of said operating zone provided with active needles (and thus based on the width of the fabric) or, more generally, based on the position in which the produced fabric has to be cut so as to be divided into the aforesaid two distinct webs.

Preferably, the knitting machine, as already described above, comprises devices for varying the number of active needles in the operating zone so as to adjust the width of the knitted fabric. Under these circumstances, the aforesaid positioning device can comprise a control unit operatively connected to a motor configured for moving the cutting device along the guide; the control unit is configured for receiving as input the number of active needles, calculating the correct position of the cutting device with respect to the collecting roll based on the fabric width corresponding to the number of active needles, and for providing as output the correct position of cutting device or for accordingly controlling the motor and directly adjusting the position of the cutting device along the guide.

Preferably, as shown in particular in FIGS. 8, 11 and 14, the take-down and/or collecting assembly 2 comprises a first opening device 85 or temple, placed on the first cutting device (e.g. mounted thereto) and upstream from the first cutting device itself. The opening device 85 is configured for receiving and keeping open the fabric produced by the needle-holding element at least on the first selvedge to be cut (and not cut yet), so as to let the cutting element act upon the selvedge once it is uniform and well stretched.

Preferably, the opening device 85 comprises a cylinder or pin provided with a plurality of rivets 86 configured for engaging the selvedge and keeping it open and stretched when entering the cutting element.

Preferably, the cylinder or pin can rotate freely on its axis so as to match fabric progress.

Basically, the "temple" keeps selvedge width constant and prevents it from getting back to the center of the knitted fabric T.

In a possible embodiment, not shown, the take-down and/or collecting assembly comprises a first detecting device configured for automatically detecting the edge of the fabric making up the selvedge to be cut, so as to actuate the cutting element and/or automatically position the cutting device along the guide. The detecting device can comprise a photoelectric cell or an optical or laser detecting device, or a scanner or optical image reader, which can detect an edge or a reference mark. The detecting device (in particular a scanner) can follow a reference mark on the fabric and accurately guide the cut made by the cutting device.

Preferably, the detecting device acts upon the aforesaid positioning device so as to directly and automatically adjust the position of the cutting device along the guide, based on a given reference mark or based on the position of the edge of the selvedge (i.e. based on the width of the produced fabric and therefore on the number of active needles).

Preferably, the detecting device is positioned upstream the first cutting device and on the knitted fabric.

In a possible embodiment, the cutting device comprises a glue dispenser positioned downstream from the cutting element and configured for dispensing an amount of glue on the edge of the fabric obtained as a result of selvedge cutting. The glue dispenser enables to fix and stabilize the edge of the knitted fabric once the selvedge has been cut, thus avoiding fraying or curling.

In a preferred embodiment, as shown in the figures, the take-down and/or collecting assembly 2 also comprises a second cutting device 90, configured for progressively cutting the produced fabric so that the fabric itself, as a result of the cutting operations performed by the first cutting device and by the second cutting device, is divided into three distinct webs. In other words, the execution of two cuts on the fabric (by the two cutting devices) divides the fabric itself into three different webs, each one with a respective width defined by the position of the two cutters.

Preferably, the second cutting device 90 is configured for progressively cutting the second selvedge of the open knitted fabric, making up the side edge of the fabric opposite the side edge of the first selvedge, so that the aforesaid three distinct webs correspond to the first selvedge, to the second selvedge and to a "central" fabric web without the two selvedges. The second cutting device 90 advantageously corresponds to the first cutting device 70 and comprises one or more of the aforesaid technical features described for the first cutting device.

The presence of two distinct cutting devices, places on the sides of the fabric under production, allows—in a clearly advantageous manner—to remove both selvedges (by cutting them) on the sides of the fabric, so as to obtain a selvedge-free fabric which is correctly collected on the collecting roll.

In further detail, also the second cutting device 90 or cutter is integral with the take-down and/or collecting assembly and rotates with it during the production of the fabric.

Moreover, the second cutting device 90 comprises a respective cutting element configured for cutting the second selvedge.

Preferably, the second cutting device 90 comprises a respective take-down roll configured for receiving the selvedge cut by the cutting element of the second cutting device, for taking it away from the cutting element itself and for maintaining it stretched.

Preferably, the second cutting device 90 is arranged upstream, preferably immediately upstream, from the collecting roll.

The second cutting device 90 is preferably arranged symmetrically, with respect to the middle line of the take-down and/or collecting assembly, and to the middle line of the dead zone, to the first cutting device 70.

Preferably, the take-down and/or collecting assembly 2 comprises second mounting elements 98 configured for enabling the positioning and mounting of the second cutting device into the take-down and/or collecting assembly.

The second mounting elements 98 comprise a respective rectilinear guide 99 developing parallel to the axis of development of the collecting roll and configured for housing the second cutting device 90 and selectively placing it in a given position with respect to the collecting roll.

The second mounting elements can comprise a respective hooking device, similar to the one described above for the first cutting device.

The second mounting elements can comprise a respective positioning device, similar to the one described above for the first cutting device.

The aforesaid control unit can be configured for moving also the second cutting device along the respective guide, for adjusting the correct position of the cutting device with respect to the collecting roll based on the fabric width corresponding to the number of active needles; as an alternative, the positioning device of the second cutting device can be equipped with its own control unit.

The take-down and/or collecting roll 2 preferably comprises a second opening device 95 or temple, positioned on the second cutting and upstream from it. The second opening device is configured for receiving and keeping open the fabric produced by the needle-holding element at least on the second selvedge to be cut, so as to let the cutting element act upon the selvedge once it is uniform and well stretched.

The take-down and/or collecting assembly can comprise a second detecting device configured for automatically detecting the edge of the fabric making up the second selvedge to be cut, so as to actuate the cutting element and preferably automatically position the cutting device along the respective guide. The second detecting device is preferably similar to the first detecting device.

The second cutting device comprises a respective glue dispenser positioned downstream from the cutting element and configured for dispensing an amount of glue on the edge of the fabric obtained as a result of cutting the second selvedge.

According to further embodiments, the take-down and/or collecting assembly can comprise a plurality of cutting devices to be positioned independently along the fabric. This enables to device the produced fabric into a plurality of distinct bands having any desired width. Typically, by using N cutting devices up to N+1 distinct fabric bands (or webs) can be obtained.

In general, the solution including several cutting devices advantageously allows to divide the produced fabric into several distinct bands. This enables for instance to produce a highly wide web and to then divide it into several bands, thus maximizing textile manufacturing. Or it is possible to produce a wide fabric having side-by-side bands characterized by various braids and divided one from the other by inner stripes (or "intermediate") selvedges designed to be cut. In this case, the cutting devices are positioned (if required, automatically by means of the detecting device which can detect the intermediate selvedges) on the intermediate selvedges, so as to perform cutting and create distinct fabric bands.

The webs or bands into which the fabric is divided can be collected—one beside the other—on the same collecting roll, or they can be sent to distinct collecting rolls.

The cutting devices of the present invention can be configured for executing a straight cut, based on the position taken by the cutting device with respect to the fabric, or to dynamically execute—i.e. directly during manufacturing—a curved cut controlled by a control unit based on a given cutting program.

The present invention also includes a software or computer program for open-type knitting machines for the open and width-variable web production, which can execute—on board a control unit of the knitting machine—one or more of the methods described above. In particular, the software is configured for implementing the following algorithm:

arranging an open-type circular knitting machine for the open and width-variable web production with a knitted fabric take-down and/or collecting assembly, according to the above detailed description;

selecting among the plurality of needles of the needle-holding element a plurality of active needles, i.e. selecting the width of the operating zone;

defining a given knitted braid or knitted structure for the fabric to be produced by means of the active needles of the operating zone;

selecting the correct angular position of the take-down and/or collecting assembly as a function of the number of active needles or of the width of the operating zone, and positioning, either manually or automatically (by means of the control unit and a drive) the take-down and/or collecting assembly in this correct angular position;

producing at least a portion of an open knitted fabric by means of the active needles of the operating zone;

automatically positioning the cutting device with respect to the produced fabric, based on the position in which the fabric has to be cut into two webs (preferably on a selvedge);

progressively cutting by means of said first cutting device the produced fabric so as to divide it into at least two distinct webs.

Basically, the software receives as input:

information on the operating zone of the needle-holding element (i.e. the number of active needles or the width of the operating zone);

information on the yarn braid (knitting structure of the fabric to be produced); and provides as input:

a command to a motor actuating the take-down and/or collecting assembly, so as to "phase it in" with the operating zone, i.e. to angularly rotate it and align it with the middle line of the fabric to be produced;

a command to the positioning device of the cutting device, so as to place it in the correct position with respect to the fabric under production, e.g. to cut a selvedge or to divide the fabric into two distinct webs.

Moreover, the software can be configured for managing a plurality of different cutting devices, if present in the take-down and/or collecting assembly.

FIGS. 16-21 show a different embodiment of the machine, software and method described above.

The machine according to this different embodiment is the same as the one described above (and shown in FIGS. 1-15) except for that, in addition or as an alternative the cutting devices 70', 70" mounted on the take-down and collecting assembly 2, this machine 1 comprises a first and a second cutting device 70', 70" installed inside the needle-holding element 5 and near the first active needle 6*a*, 7*a* and near the last active needle 6*b*, 7*b*, 6*b'*, 7*b'*, respectively (these needles are shown in FIGS. 5, 6 and 7 representing also the embodiment described here).

By comparing FIGS. 2 and 16 it can be easily inferred which is the position of the first and second cutting device 70', 70" lying inside the cylinder 8 and under the needle-holding plate 9.

The first and second cutting device 70', 70" rotate with the fabric during the production thereof and are placed immediately downstream from the needles (with respect to a feeding direction of the knitted fabric "T" getting downwards). These are configured for trimming the edges of the fabric and in particular for cutting only the yarns protruding from the selvedges of the open fabric "T" just produced.

The two cutting devices 70', 70" basically have symmetrical structures, so that only one thereof will be described, i.e. the first one 70', shown in detail in FIGS. 20 and 21.

The first cutting device 70' comprises a box-shaped supporting body 200 carrying a fixed blade 201 and a mobile blade 202 pivoted to the supporting body 200. The supporting body 200 contains a pneumatic actuator, not shown, which rotates a shaft getting through a slot in the mobile blade 202. The pneumatic actuator is connected to a source of pressurized air by means of a coupling 203. The rotation of the shaft causes the opening/closing movement of the cutting element 71 made up of the fixed blade 201 and of the mobile blade 202 (scissors). A suction duct, not shown, is obtained in the supporting body and is connected to a fixed suction element 204 by means of a tube 205', 205" (shown in FIG. 19) and a respective coupling 206 placed on the support body. The suction duct ends with a suction opening 207 built into the supporting body and opening near the cutting element 71.

The fixed suction element 204, the tube 205', 205", the suction duct and the suction opening 207 are part of a suction device, better shown in FIG. 19, whose function is to remove cut yarns.

The suction device further comprises a rotating manifold 208 consisting of a fixed part 209 firmly connected to the basement 3, and of a rotating part 210 turnably coupled with the fixed part 209 and mounted under the take-down and/or collecting assembly 2. The rotating part 210 is firmly connected to the take-down and/or collecting assembly 2 so as to rotate with it during the operation of the machine 1.

First tubes 205' connect the suction opening 207 to the rotating part 210. The first tubes 205' get through the volume delimited by the needle-holding cylinder 8, are supported by the beam 16 and by the side plates 17, 18 of the take-down and/or collecting assembly 2 and end on the rotating manifold 208. A second tube 205" connect the fixed part 209 of the rotating manifold 208 to the fixed suction element 204 by means of a perforated tank 20 acting as a filter and configured for collecting the sucked yarns.

The machine 1 shown further comprises adjusting elements of manual type, operatively associated with the first and the second cutting device 70', 70" and configured for varying the position of said first and second cutting device 70', 70" with respect to the first active needle 6*a*, 7*a* and to the last active needle 6*b*, 7*b*, 6*b'*, 7*b'*.

The adjusting elements are configured for moving and blocking the cutting devices 70', 70" along a circular path coaxial with the central axis. Their position is set, preferably during the operating cycle, after selecting the width of the operating zone 10, i.e. the plurality of active needles.

In the embodiment shown, the adjusting elements comprise a first arm 211 firmly connected to the first cutting device 70', and a second arm 212 firmly connected to the second cutting device 70". The two arms 211, 212 are curved, extend one towards the other (FIG. 16) and have respective eyelets 213, 214 placed at the ends.

Said ends are firmly connected to a lid 215 (shown in FIG. 17) closing the needle-holding plate 9 on the zone 11 without needles. To this purpose, the lid 215 is equipped with a first graduated slit 216 and with a second graduated slit 217 developing one after the other as an arc whose center is in the central axis "X-X".

Pins and/or screws, not shown, inserted into the slits 216, 217 and into each one of the two eyelets 213, 214 allow to fasten the two arms 211, 212 and therefore the cutting devices 70', 70" to the lid 215. By loosening the screws, the eyelets 213, 214 and the arms 211, 212 can be moved dragging the cutting devices 70', 70" so as to then block them in the new selected positions. During this adjusting movement, the cutting devices 70', 70" slide inside slots 218, 219 obtained in a guiding ring 220 mounted in the cylinder 8 (FIG. 16).

As can be noted, the second arm 212, the second slit 217 and the second slot 219 are longer than the first arm 211, the first slit 216 and the first slot 218, respectively. Thus, the width of the adjusting movement of the second cutting device 70" is larger than the adjusting width of the first cutting device 70'. The second cutting device 70" can then be correctly positioned as function of the number of deactivated needles 6 starting from the last needle 6*b*, 7*b*. The movement of the first cutting device 70' is more limited since the first active needle 6*a*, 7*a* is always the same.

The invention thus conceived can be subjected to various changes and variants, all of which fall within the scope of the inventive idea, and the components mentioned here can be replaced by other technically equivalent element.

The present invention can be used both on new and on existing machines, in the latter case for adding new functionalities and implementing the aforesaid methods.

The invention achieves important advantages. First of all, the invention allows to overcome at least some of the drawbacks of known technique.

The invention allows to obtain a circular knitting machine which can solve the problems related to selvedges arising in the production of fabrics with open-type knitting technology, i.e. with a directly open and width-variable web production. As a matter of fact, the knitting machine of the present invention can remove (by cutting) the selvedges and/or only the yarns protruding from the edges of the produced fabric, directly inside the needle-holding cylinder and/or the take-down and/or collecting assembly, so that the collected fabric is without such selvedges or yarns. This is a great advantage since yarns and/or selvedges constitute fabric portions that cannot be used for manufacturing textile and clothing items and anyway have to be removed and/or rejected. The solution on which the present invention is based allows to remove selvedges and/or yarns directly in the machine, i.e. during fabric production and collection. It is thus possible to avoid a quite complex operation, which in prior art is performed afterwards, typically when manufacturing a textile item starting from the fabric. This allows to reduce time and global costs related to the whole cycle including the production of a fabric and the manufacture of a textile item, e.g. an item of clothing.

Moreover, the knitting machine of the present invention can remove yarns only and/or selvedges with high accuracy, since this operation is performed—by means of the cutting devices—directly on the fabric web getting out of the knitting head, and before it is collected on a roll.

In addition, the knitting machine of the present invention enables to eliminate the problem, which is typical at the state of the art (without selvedge cutting), related to fabric piling up on the edges of the collecting roll due to selvedges curling up and overlapping in a non-uniform manner. The result obtained with the present invention is the possibility of correctly collecting in a single layer the web under formation, thus obtaining a well-stretched and uniform fabric roll.

The present invention, which allows to correctly roll up the fabric, produced directly in open mode, onto the collecting roll, further enables to fully exploit the opportunities offered by the textile technology involving the open and width-variable web production. As a matter of fact, the possibility of selectively positioning the cutting devices inside the needle-holding cylinder and/or the take-down and/or collecting assembly allows to cut the yarns and/or selvedges for any width of the produced web (i.e. for every number of active needles); the cutting devices can be positioned exactly on the selvedges for every knitting cycle. Basically, the machine according to the present invention combines yarn and/or selvedge cutting with the direct open and width-variable web production.

The present invention offers particular advantages should the knitting machine comprise devices for adjusting the angular position of the take-down and/or collecting assembly with respect to the dead zone of the needle-holding element, i.e. based on the number of active needles. As a matter of fact, in this case the take-down and/or collecting assembly is always centered with respect to the middle line of the produced fabric, and so are also the cutting devices (since they are mounted on the needle-holding cylinder near said needles and/or integral with the take-down and/or collecting assembly). In addition, the possibility to adjust the position of the cutting devices by sliding them in the slots of the guiding ring and/or by moving parallel to the collecting roll, allows to effectively cut the yarns and/or selvedges for every fabric width (which is exactly a function of the number of active needles).

The knitting machine of the present invention thus enables to cut the yarns and/or selvedges of the fabric web under formation, and to correctly collect it into a single layer, whatever the number of active needles used and thus for all web widths.

In general, the knitting machine according to the present invention, of the open-type and with the open and width-variable web production, has a higher quality than the solutions of the prior art.

The invention claimed is:

1. An open-type circular knitting machine for the open and width-variable web production, comprising:

a base;

a knitting head mounted onto the base and comprising:

at least a needle-holding element having at least a plurality of needles arranged around a central axis; a first active needle and a last active needle of the plurality delimiting between them a dead zone of the needle-holding element without needles and/or without active needles, and an operating zone shaped as an arc of circle and provided with active needles;

control means operatively connected at least to the active needles so as to selectively actuate the active needles in order to produce an open knitted fabric, the open knitted fabric extending longitudinally in a continuous manner between two side edges making up two selvedges of the knitted fabric; and at least one cutting device arranged downstream from the needle-holding element and configured for progressively cutting and/or trimming the produced fabric;

wherein the needle-holding element rotates around the central axis during the formation of the knitted fabric, and wherein the machine comprises devices for varying the number of active needles in the operating zone so as to adjust the height of the knitted fabric.

2. The machine according to claim 1, comprising:

a take-down and/or collecting assembly for the knitted fabric under production, arranged downstream from the knitting head with respect to a feeding direction of the knitted fabric under production, wherein the take-down and/or collecting assembly is configured for rotating integral or coordinated with the needle-holding element during the production of the knitted fabric.

3. The machine according to claim 2, wherein the take-down and/or collecting assembly comprises at least a first cutting device of the at least one cutting device, the first cutting device being configured for progressively cutting the produced fabric so as to divide it into at least two distinct webs.

4. The machine according to claim 3, wherein the first cutting device is configured for progressively cutting a first selvedge of the open fabric, so that the two distinct webs correspond to the first selvedge and to a fabric web without the first selvedge, or wherein the first cutting device or "cutter" is integral with the take-down and/or collecting assembly and rotates with it during the production of the fabric, or wherein the first cutting device comprises a cutting element configured for cutting the fabric produced by the knitted machine, the cutting element being a blade or a pair of scissors or an ultrasonic cutting element or a heating cutting element.

5. The machine according to claim 3, wherein the first cutting device comprises a take-down roll configured for receiving the selvedge cut by the cutting element, for taking it away from the cutting element itself and for maintaining it stretched; or wherein the take-down and/or collecting assembly comprises:

spreading devices configured for opening and stretching in a single layer the knitted fabric produced by the knitting head, and comprising at least a spreading bar;

devices for piling up the knitted fabric stretched, comprising at least a collecting roll;

and wherein the first cutting device is arranged upstream from the collecting roll.

6. The machine according to claim 3, wherein the take-down and/or collecting assembly comprises first mounting elements configured for enabling the positioning and mounting of the first cutting device into the take-down and/or collecting assembly, or wherein the mounting elements comprise a rectilinear guide developing parallel to an axis of development of the collecting roll and configured for housing the first cutting device and selectively placing it in a given position with respect to the fabric produced by the knitting machine and/or to the collecting roll.

7. The machine according to claim 6, wherein the mounting elements comprise a hooking device associated with the first cutting device and configured for enabling a manual, reversible mounting of the first cutting device to the rectilinear guide in a given position, along the guide, which can be selected based on the width of the operating zone provided with active needles and/or based on the position in which the produced fabric has to be cut so as to be divided into the two distinct webs, or wherein the mounting elements comprise a positioning device acting upon the first cutting device and configured for enabling an automatic selection of the position of the first cutting device along the rectilinear guide.

8. The machine according to claim 3, wherein the take-down and/or collecting assembly comprises at least a second cutting device of the at least one cutting device, configured for progressively cutting the produced fabric so that the produced fabric, as a result of the cutting operations made by the first cutting device and by the second cutting device, is divided into three or more distinct webs, or wherein the second cutting device is configured for progressively cutting a second selvedge of the open knitted fabric, making up the side edge of the fabric opposite the side edge of the first selvedge, so that the three or more distinct webs correspond at least to the first selvedge, to the second selvedge and to a fabric web without the first and the second selvedge, or wherein the second cutting device corresponds to the first cutting device and comprises one or more of the aforesaid technical features described for the first cutting device.

9. The machine according to claim 3, comprising devices for adjusting the angular position of the take-down and/or collecting assembly with respect to the dead zone of the needle-holding element around the central axis, or wherein the take-down and/or collecting assembly is hung below the knitting head, and wherein the adjusting devices are operatively placed between the take-down and/or collecting assembly and the knitting head, or wherein the adjusting devices are of the manual adjustment type or comprise at least a motor configured for moving the take-down and/or collecting assembly with respect to the needle-holding element, or wherein: adjusting devices comprise a control unit operatively connected to a motor configured for moving the take-down and/or collecting assembly with respect to the needle-holding element; the control unit is configured for receiving as input the number of active needles, calculating the correct position of the take-down and/or collecting assembly corresponding to the number of active needles, and for providing as output the angular position of the take-down and/or collecting assembly or for accordingly controlling the motor and directly adjusting the angular position.

10. The machine according to claim 1, wherein the at least one cutting device is arranged near the needle-holding element; and/or the at least one cutting device is arranged downstream from the needles with respect to a feeding direction of the produced fabric; or wherein the at least one cutting device is configured for cutting and/or trimming at least one selvedge of the open fabric; wherein the at least one cutting device rotates with the fabric during the production of the fabric; the at least one cutting device comprises a cutting element.

11. The machine according to claim 10, wherein the at least one cutting device comprises a first cutting device positioned near the first active needle and configured for cutting and/or trimming a first selvedge of the open fabric, and a second cutting device positioned near the last active needle and configured for cutting and/or trimming a second selvedge of the open fabric.

12. The machine according to claim 10, comprising adjusting elements operatively associated with a first cutting device and/or a second cutting device of the at least one cutting device, and the adjusting elements being configured for varying the position of the first and/or second cutting device with respect to the first active needle or to the last active needle; and/or wherein the adjusting elements are configured for moving and blocking the first and second cutting devices along a circular path coaxial with the central axis.

13. The machine according to claim 12, comprising a suction device operatively associated with the at least one cutting device and configured for removing waste deriving from the cutting operation; or wherein the suction device has a suction opening placed near the cutting element of the at least one cutting device; or wherein the at least one cutting device comprises a supporting body carrying the cutting element, wherein the suction opening is built into the supporting body.

14. The machine according to claim 13, wherein the suction device comprises: a suction element, fixed with respect to the base; a rotating manifold positioned under the knitting head; first tubes in fluid communication with the suction opening of the at least one cutting device and with the rotating manifold; second tubes in fluid communication with the rotating manifold and with the suction element.

15. The machine according to claim 14, the machine comprising:

a take-down and/or collecting assembly for the knitted fabric under production, arranged downstream from the knitting head with respect to a feeding direction of the knitted fabric under production, wherein the take-down and/or collecting assembly is configured for rotating integral or coordinated with the needle-holding element during the production of the knitted fabric, and wherein the first tubes are mounted onto the take-down and/or collecting assembly and the rotating manifold is positioned under the take-down and/or collecting assembly.

16. A method for producing a knitted fabric comprising the steps of:

arranging an open-type circular knitting machine for the open and width-variable web production, comprising at least:

a base;

a knitting head mounted onto the base and comprising:

at least a needle-holding element having at least a plurality of needles arranged around a central axis; a first active needle and a last active needle of the plurality delimiting between them a dead zone of the needle-holding element without needles and/or without active needles, and an operating zone shaped as an arc of circle and provided with active needles;

control means operatively connected at least to the active needles so as to selectively actuate the active needles in order to produce an open knitted fabric, the open knitted fabric extending longitudinally in a continuous manner between two side edges making up two selvedges of the knitted fabric;

at least one cutting device arranged downstream from the needle-holding element and configured for progressively cutting and/or trimming the produced fabric;

wherein the needle-holding element rotates around the central axis, during the formation of the knitted fabric, and wherein the machine comprises devices for varying the number of actives needles in the operating zone so as to adjust the height of the knitted fabric;

producing at least a portion of an open knitted fabric, the open knitted fabric extending longitudinally in a continuous manner between two side edges making up two selvedges of the knitted fabric;

progressively cutting and/or trimming, by means of the at least one cutting device, the produced fabric.

17. The method according to claim 16, wherein the circular knitting machine comprises:

a take-down and/or collecting assembly for the knitted fabric under production, arranged downstream from the knitting head with respect to a feeding direction of the knitted fabric under production, wherein the take-down and/or collecting assembly is configured for rotating integral or coordinated with the needle-holding element during the production of the knitted fabric, and/or wherein the take-down and/or collecting assembly comprises at least one first cutting device of the at least one cutting device, the first cutting device being configured for progressively cutting the produced fabric so as to divide it into at least two distinct webs;

wherein the two side edges are two selvedges of the fabric;

wherein the produced fabric is cut so as to divide it into two distinct webs;

wherein the cutting step is made in a continuous and synchronized manner with the step of producing at least a portion of an open knitted fabric, or wherein during the knitting step the first cutting device is configured for progressively cutting a first selvedge of the open knitted fabric, so that the two distinct webs correspond to the selvedge and to a fabric web without the selvedge.

18. The method according to claim 16, wherein the at least one cutting device is arranged near the needle-holding element; or the at least one cutting device is arranged immediately downstream from the needles with respect to a feeding direction of the produced fabric; or wherein the cutting step comprises trimming at least one selvedge of the open fabric or wherein trimming comprises cutting only and at least partly yarns protruding from the fabric; wherein the cutting step is made in a continuous and synchronized manner with the step of producing at least a portion of an open knitted fabric.

19. The method according to claim 18, wherein the at least one cutting device comprises a first cutting device positioned near the first active needle, and a second cutting device positioned near the last active needle; wherein the cutting step comprises cutting and/or trimming a first selvedge of the open fabric; wherein trimming comprises cutting only and at least partly yarns protruding from the fabric.

20. The method according to claim 16, comprising:

selecting among the plurality of needles of the needle-holding element a plurality of active needles, i.e. selecting the width of the operating zone;

adjusting the position of the at least one cutting device with respect to the first active needle and/or to the last active needle as a function of the width of the operating zone.

* * * * *